US012127608B2

(12) United States Patent
Casillas et al.

(10) Patent No.: US 12,127,608 B2
(45) Date of Patent: Oct. 29, 2024

(54) ARTICLE OF APPAREL INCLUDING A BLADDER

(71) Applicant: NIKE, Inc., Beaverton, OR (US)

(72) Inventors: Tina M. Casillas, Portland, OR (US); Risha Dupre, Tigard, OR (US); Sam Lacey, Portland, OR (US); Austin J. Orand, Portland, OR (US); Nadia M. Panian, Beaverton, OR (US); Adam Parkinson, Beaverton, OR (US); Victoria Rind, Beaverton, OR (US); Jeffrey C. Spanks, Portland, OR (US); Simon Quay, Portland, OR (US); Kimberly A. Sokol, Vancouver, WA (US)

(73) Assignee: NIKE, Inc., Beaverton, OR (US)

( * ) Notice: Subject to any disclaimer, the term of this patent is extended or adjusted under 35 U.S.C. 154(b) by 123 days.

(21) Appl. No.: 17/816,647

(22) Filed: Aug. 1, 2022

(65) Prior Publication Data

US 2023/0032939 A1 Feb. 2, 2023

Related U.S. Application Data

(60) Provisional application No. 63/366,768, filed on Jun. 21, 2022, provisional application No. 63/228,310, filed on Aug. 2, 2021.

(51) Int. Cl.
*A41C 3/14* (2006.01)

(52) U.S. Cl.
CPC ..... *A41C 3/146* (2013.01)

(58) Field of Classification Search
CPC ..... A41C 3/146
USPC ..... 450/38
See application file for complete search history.

(56) References Cited

U.S. PATENT DOCUMENTS 5,347,656 A * 9/1994 Fabritz ..... A41C 3/105 450/38
5,697,974 A * 12/1997 Wang ..... A41C 3/105 623/7
6,015,332 A * 1/2000 Lee ..... A41C 3/144 450/38
6,080,037 A * 6/2000 Lee ..... A41C 3/105 450/38
6,302,760 B1 * 10/2001 Dai ..... A41C 3/105 450/38
6,461,221 B1 * 10/2002 Stilwell ..... A41C 3/0007 450/38

(Continued)

FOREIGN PATENT DOCUMENTS

WO WO-2020073021 A1 4/2020

OTHER PUBLICATIONS

European Patent Office (ISA), International Search Report and Written Opinion for PCT App. No. PCT/US2022/074428, mailed Nov. 10, 2022.

*Primary Examiner* — Gloria M Hale
(74) *Attorney, Agent, or Firm* — Honigman LLP; Matthew H. Szalach; Jonathan P. O'Brien

(57) ABSTRACT

An article of apparel includes a bladder including an interior void, a compressible component disposed within the interior void and including a first zone, the first zone operable between a contracted state and a relaxed state, and a port fluidly coupled to the bladder and operable to selectively permit fluid communication with the interior void.

30 Claims, 25 Drawing Sheets

(56) References Cited

U.S. PATENT DOCUMENTS

| | | | | |
|---|---|---|---|---|
| 7,879,091 | B1 * | 2/2011 | Martin | A61F 2/52 450/55 |
| 9,468,236 | B1 * | 10/2016 | Sherry | A41C 3/105 |
| 10,986,881 | B2 * | 4/2021 | Stanton | A41C 3/0064 |
| 2010/0068973 | A1 * | 3/2010 | Tseng | B32B 3/08 450/55 |
| 2011/0035358 | A1 * | 2/2011 | Naik | G06F 16/10 718/1 |
| 2013/0012100 | A1 * | 1/2013 | Chen | A41C 3/105 450/38 |
| 2021/0120915 | A1 | 4/2021 | Panian | |

* cited by examiner

ARTICLE OF APPAREL INCLUDING A BLADDER

CROSS REFERENCE TO RELATED APPLICATIONS

This application claims priority under 35 U.S.C. § 119(e) to U.S. Provisional Application 63/228,310, filed on Aug. 2, 2021, and U.S. Provisional Application 63/366,768, filed on Jun. 21, 2022. The disclosure of this prior application is considered part of the disclosure of this application and is hereby incorporated by reference in its entirety.

FIELD

The present disclosure relates generally to an adjustment element for an article of apparel.

BACKGROUND

This section provides background information related to the present disclosure which is not necessarily prior art.

Articles of apparel such as garments and headwear and articles of footwear such as shoes and boots, typically include a receptacle for receiving a body part of a wearer. For example, an article of footwear may include an upper and a sole structure that cooperate to form a receptacle for receiving a foot of a wearer. Likewise, garments and headwear may include one or more pieces of material formed into a receptacle for receiving a torso or head of a wearer.

Articles of apparel or footwear are typically adjustable and/or are formed from a relatively flexible material to allow the article of apparel or footwear to accommodate various sizes of wearers, or to provide different fits on a single wearer. While conventional articles of apparel and articles of footwear are adjustable, such articles do not typically allow a wearer to conform the shape of the article to a body part of the wearer. For example, while clasps and elastic bands adequately secure an article of apparel to a wearer by contracting or constricting a portion of a garment around the wearer's upper body, they do not cause the garment to conform to the user's upper body. Accordingly, an optimum fit of the article of apparel around the upper body is difficult to achieve.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figures 1, 1A:
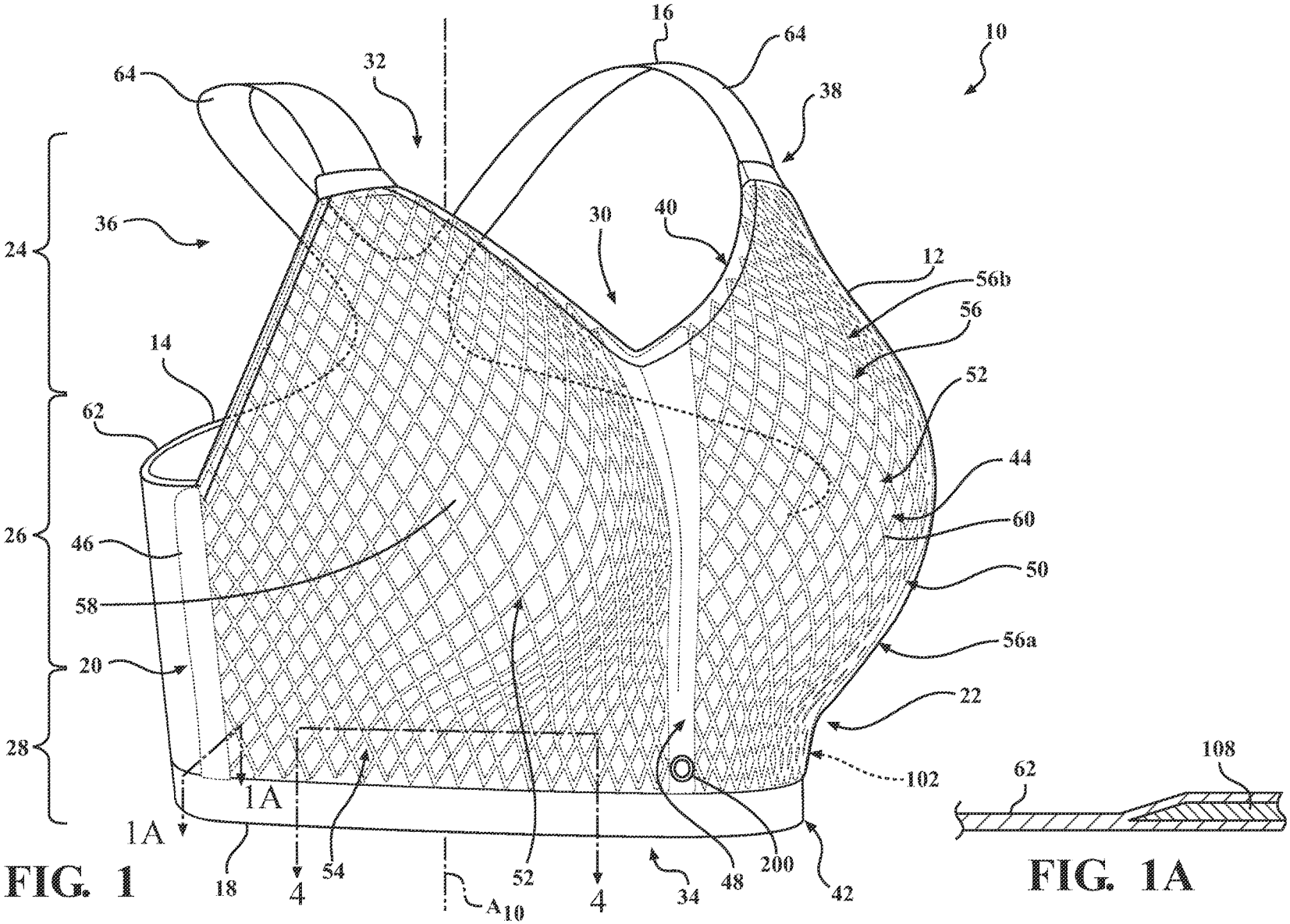
FIG. 1 is a perspective view of an example of an article of apparel according to the present disclosure.
FIG. 1A is a partial cross-sectional view of the article of apparel of FIG. 1, taken along Line 1A-1A in FIG. 1, where a compressible component tapers toward a rear panel of the article of apparel.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As used herein, the term "approximately" means within a range of plus or minus 5 percent of an indicated value or range, optionally within a range of plus or minus 10 percent of an indicated value or range.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, an article of apparel includes a bladder that includes an interior void, a compressible component disposed within the interior void and including a first zone, the first zone operable between a contracted state and a relaxed state, and a port fluidly coupled to the bladder and operable to selectively permit fluid communication with the interior void.

The article of apparel may include one or more of the following optional features. For example, the compressible component may include a first cup and the first zone may be spaced apart from the first cup. Additionally or alternatively, the first zone may extend over at least a portion of the first cup. In one configuration, the first zone may include a first plurality of reliefs having a first shape. The compressible component may include a second zone disposed adjacent to the first zone and may include a second plurality of reliefs. The reliefs of the second plurality of reliefs may include the same shape as reliefs of the first plurality of reliefs. The reliefs of the second plurality of reliefs may be oriented in a transverse direction relative to the reliefs of the first plurality of reliefs.

In one configuration, the article of apparel may include a lining operable to surround a torso of a wearer and a second cup spaced apart from the first cup, the first cup and the second cup may extend to a respective apex in a direction away from the lining. The compressible component may extend at least partially over the first cup and the second cup. Optionally, the port may be disposed between the first cup and the second cup, the first cup and the second cup being in fluid communication.

In another configuration, an article of apparel includes a bladder including an interior void, a compressible component disposed within the interior void and including a first cup extending to a first apex and a second cup extending to a second apex, the compressible component including a first zone operable between a contracted state and a relaxed state, and a port fluidly coupled to the bladder and operable to move the first zone between the contracted state and the relaxed state by selectively permitting fluid communication with the interior void.

The article of apparel may include one or more of the following optional features. For example, the first zone may extend over the first apex. Additionally or alternatively, the first zone may extend over the second apex. The first zone may include a first plurality of reliefs having a first shape. Optionally, the compressible component may include a second zone disposed adjacent to the first zone and including a second plurality of reliefs. Reliefs of the second plurality of reliefs may include the same shape as the reliefs of the first plurality of reliefs. The first zone may extend at least partially over the first apex and the second apex. The port may be disposed between the first cup and the second cup, the first cup and the second cup being in fluid communication.

Figure 2:
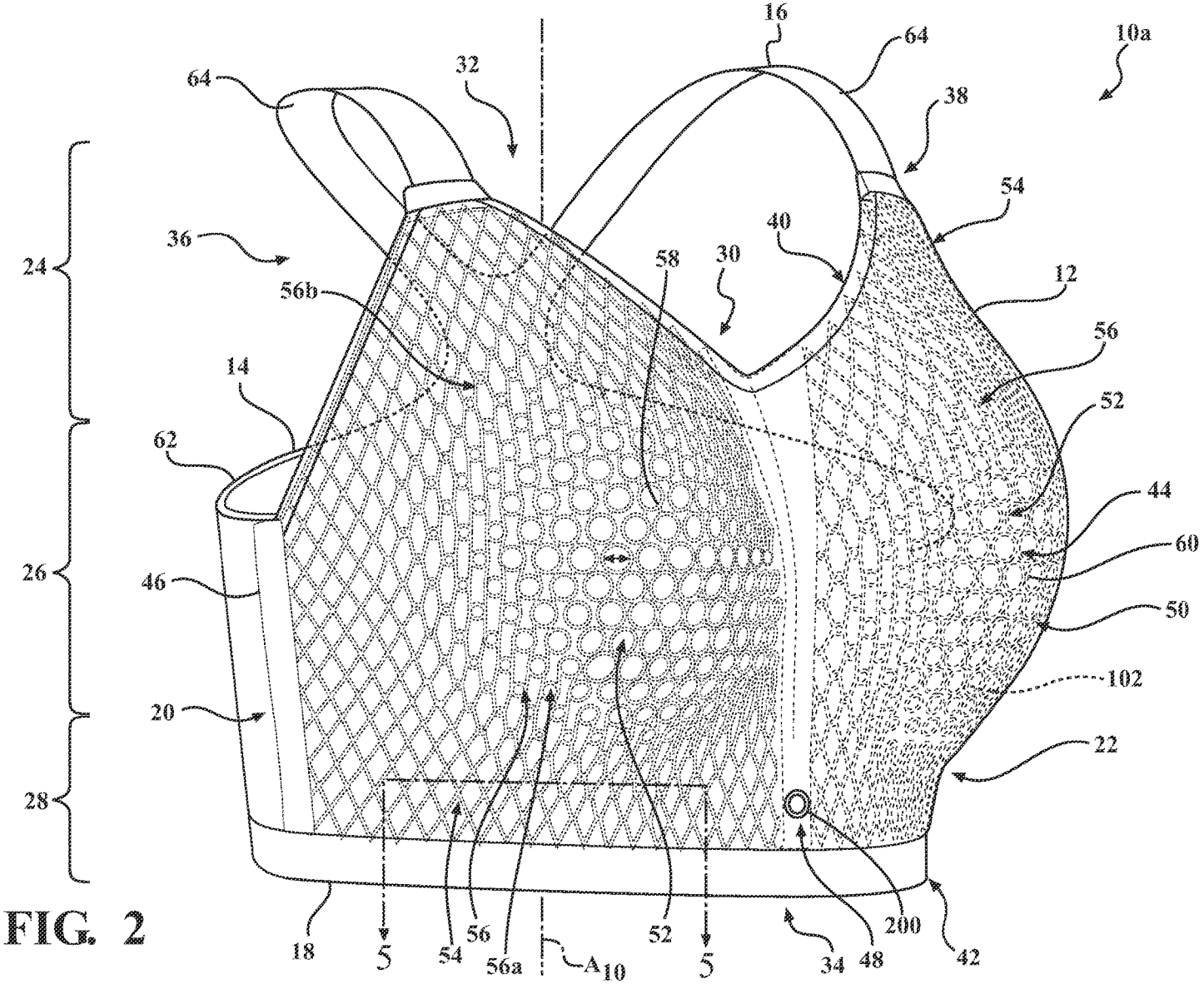
FIG. 2 is a perspective view of another example of an article of apparel according to the present disclosure.
Figure 3:
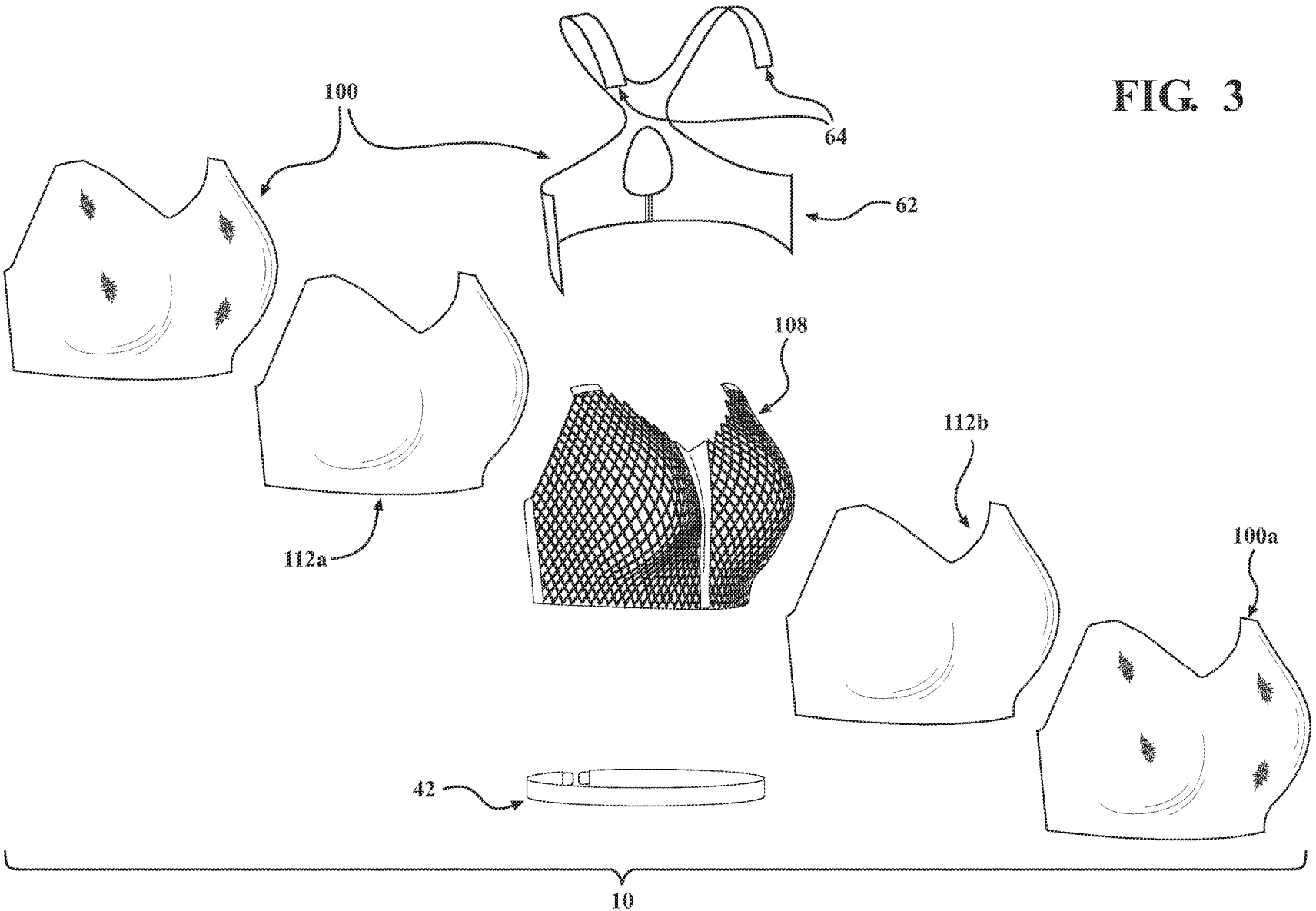
FIG. 3 is an exploded view of the article of apparel of FIG. 1.

Referring to FIGS. 1-3, an upper-torso article of apparel 10 is illustrated and includes any garment configured to cover an upper-torso of a wearer. The illustrated upper-torso article of apparel 10 includes a bra 10, however the bra 10 may include other types of garments for a male or female, including a strapless bra, a camisole, a base-layer shirt, a singlet, swimwear, sports bra, or other garments with built-in support. FIG. 2 depicts another example of a configuration of a bra 10*a*. In view of the substantial similarity in structure and function of the components associated with the bra 10*a* with respect to the bra 10, like reference numerals are used hereinafter and in the drawings to identify like components while like reference numerals containing letter extensions are used to identify those components that have been modified. The bras 10, 10*a* are contemplated as being a support garment that may include a first breast covering portion and a second breast covering portion. The first and second breast coverings may optionally include one or more zones, as described in more detail below with respect to FIGS. 8-14.

Referring to FIGS. 1 and 2, the bras 10, 10*a* each may include an anterior side 12 associated with the front of the body of a wearer when the bras 10, 10*a* are in use, and a posterior side 14 associated with the back of the body of a wearer when the bras 10, 10*a* are in use. The bras 10, 10*a* may further include an upper end 16 configured to receive the shoulders of the wearer, and a lower end 18 configured to receive the ribcage of a wearer. A longitudinal axis $A_{10}$ of the bras 10, 10*a* extends along a height of the bras 10, 10*a* from the upper end 16 to the lower end 18 perpendicular to a ground surface, and generally divides the bras 10, 10*a* into a right side 20 and a left side 22. Accordingly, the right side 20 and the left side 22 respectively correspond with opposite sides of the bras 10, 10*a* and extend from the upper end 16 to the lower end 18. As used herein, a longitudinal direction refers to the direction extending from the upper end 16 to the lower end 18, while a sagittal direction refers to the direction transverse to the longitudinal direction and extending from the anterior side 12 to the posterior side 14. A frontal axis or direction refers to the direction extending from the right side 20 to the left side 22.

The bras 10, 10*a* may be divided into one or more regions. The regions may include a shoulder region 24, a chest region 26, and a ribcage region 28. The shoulder region 24 is associated with the clavicle and scapula bones of a shoulder. The chest region 26 may correspond with the true ribs and breast tissue area of an upper-torso, and the ribcage region 28 may correspond with the false and floating ribs of an upper-torso.

The bras 10, 10*a* further include an interior cavity 30, a neck-receiving opening 32, a torso-receiving opening 34, a right arm-receiving opening 36, and a left arm-receiving opening 38. As shown in FIGS. 1 and 2, the neck-receiving opening 32 is formed on the upper end 16 of the bras 10, 10*a* and the torso-receiving opening 34 is formed on the lower end 18 of the bras 10, 10*a*. The neck-receiving opening 32 is further formed by a neckline 40 extending along a perimeter of the neck-receiving opening 32. Similarly, the torso-receiving opening 34 is further formed by a band 42 extending along a perimeter of the torso-receiving opening 34. While the band 42 is illustrated as including a clasp (FIG. 3), it may alternatively be circumferentially connected at the lower end 18 by an elastic band.

The bras 10, 10*a*, and components thereof, may be further described as including various subcomponents or regions. For example, the bras 10, 10*a* include a front panel 44 having a right panel 46 disposed at the anterior side 12 and extending from the shoulder and chest regions 24, 26 to the ribcage region 28 and from the right side 20 to a center bridge 48 disposed between the right side 20 and the left side 22. As best shown in FIGS. 1 and 2, the front panel 44 further includes a left panel 50 disposed at the anterior side 12 and extending from the chest region 26 to the ribcage region 28 and from the left side 22 toward the center bridge 48.

The right panel 46 and the left panel each further include a central cup region 52 associated with the bust line of the wearer, a perimeter cup region 54 disposed around the perimeter of the right and left panels 46, 50 and a transition region 56 disposed between the central cup region 52 and the perimeter cup region 54. A first cup 58 and a second cup 60 of the bras 10, 10*a* are disposed within the central cup region 52 and extend to a respective apex. Each of the first cup 58 and the second cup 60 includes a generally convex shape to accommodate and provide support for the chest of the wearer while in-use. The central cup region 52 includes a generally convex shape to accommodate and provide support for the chest of the wearer while in-use.

The transition region 56 of the front panel 44 may include a bottom region 56*a* disposed around a bottom portion of the central cup region 52 and proximate to the lower end 18 of the bras 10, 10*a* and an upper region 56*b* disposed around an upper portion of the central cup region 52 and neckline 40 of the bras 10, 10*a*. More specifically, the upper region 56*b* refers to the portion of each panel 46, 50 that extends upwardly from a respective one of the cups 58, 60 and corresponds to an upper bust area of the wearer, while the bottom region 56*a* refers to the portion of each panel 46, 50 that extends downwardly from a respective one of the cups 58, 60 and corresponds to the under bust of the wearer. The bra 10 illustrated in FIG. 1 further includes an adjustment element 102 and a port 200 operable to move adjustment element 102 between a relaxed state and a constricted state. The bra 10*a* illustrated in FIG. 2 also includes the port 200 and another example of an adjustment element 102*a*, described below, that cooperate with the perimeter cup and transition regions 54, 56 to expand and contract the bra 10*a*, while the central cup region 52 may remain generally passive. Stated differently, the perimeter cup and transition regions 54, 56 of the bra 10*a* may compress about the wearer to provide structural support for the upper torso of the wearer, while the passive condition of the central cup region 52 minimizes compressive engagement of sensitive portions of the upper torso of the wearer.

The bras 10, 10*a* may further include a back panel 62 and a pair of straps 64, extending between the anterior side 12 and the posterior side 14 of the bras 10, 10*a*. The back panel 62 wraps across the posterior side 14 from the right side 20 to the left side 22, and includes a height that tapers in a direction from the straps 64 to the respective right side 20 and left side 22. The pair of straps 64 extend from the back panel 62 and generally form a "T" or "Y" shape and, further, extend over the shoulders of the wearer and connect to the right panel 46 and the left panel 50 at the anterior side 12 of the bras 10, 10*a*.

With reference to FIG. 3, the bra 10 may include a lining 100 opposing a wearer during use and at least partially forming the interior cavity 30 (FIG. 1). Although described with respect to the bra 10, it is contemplated that the bra 10*a* may also include the lining 100 as described herein. It is contemplated that the lining 100 may be incorporated as part of the front panel 44 and/or the back panel 62 (FIG. 1). Additionally or alternatively, the lining 100 may also be incorporated in other portions of the bra 10 including, but not limited to, the straps 64, the center bridge 48, and/or the band 42. The lining 100 may be formed from one or more materials that are coupled together. For example, the materials of the lining 100 may be stitched or adhesively bonded together. Suitable materials of the lining 100 may include, but are not limited to stretch woven fabric, knit fabric, non-woven fabric and/or a composite construction. Moreover, the lining 100 may possess moisture-management characteristics such as wicking, breathability, fast-drying times, and other similar characteristics. The lining 100 may include a combination of one or more substantially inelastic or non-stretchable materials and one or more substantially elastic or stretchable materials disposed in different regions of the bra 10 to facilitate movement of the bra 10 between a tightened state and a loosened state. The one or more elastic materials may include any combination of one or more elastic fabrics such as, without limitation, spandex, elastane, rubber or neoprene. The one or more inelastic materials may include any combination of one or more of thermoplastic polyurethanes, nylon, leather, vinyl, or another material/fabric that does not impart properties of elasticity. Accordingly, the lining 100 may stretch, thereby allowing the bra 10 to stretch around the upper-torso to be easily donned and doffed.

Referring to FIGS. 1-4B, the front panel 44 of the bra 10 may further include the adjustment element 102 attached to the lining 100. In some implementations, the bra 10 may optionally include an additional outer layer or shell 100*a* attached to the lining 100 to enclose the adjustment element 102 between the lining 100 and the shell 100*a*. The adjustment element 102 includes a bladder 104 forming an interior void 106 having a compressible component or infill 108 disposed therein. It is generally contemplated that the bladder is configured to form a three-dimensional shape. The three-dimensional shape may be based on a body part shape and/or may be a bra cup shape. In one example, the three-dimensional shape is based on a bra shape including a first breast covering portion and a second breast covering portion. Further, the three-dimensional shape includes a middle connecting portion between the first breast covering portion and the second breast covering portion. In one example, the compressible component includes a plurality of reliefs in each of the first breast covering portion and the second breast covering portion.

In another example, the compressible component includes the plurality of reliefs in each of the first breast covering portion and the second breast covering portion, but the compressible component does not include the plurality of apertures in the middle connecting portion.

The bladder 104 is operable to transition between a fully relaxed state, a fully contracted or constricted state, and one or more intermediate states. In one example, the bladder 104 is configured to have a first three-dimensional shape and is configured to transition from the first three-dimensional shape to a second three-dimensional shape or vice-versa, responsive to a change in an amount of vacuum in the interior space. In one example, the first three-dimensional shape and the second three-dimensional shape may be the same shape but have different overall sizes (e.g., transition to smaller size from a larger size responsive to increase in vacuum). As illustrated in FIG. 1A, it is also contemplated that the compressible component 108 may taper toward the rear panel 62 to form a graded low-profile from the central cup region 52 toward the rear panel 62 to minimize the profile of the compressible component 108 relative to the rear panel 62.

The bladder 104 may include a first zone and a second zone, such that the first zone is operable to transition between the fully relaxed state, the fully expanded state, and one or more of the intermediate states while the second zone may substantially remain in the same state. The zones of the bladder 104 are described in more detail below with respect to FIGS. 8-14 and it is contemplated that each zone is configured to provide a degree of containment to a wearer. The degree of containment may be different across different zones of the bladder. In addition, the first zone may be configured for selective fluid communication between an interior space of the first zone and the atmosphere, as described below with respect to FIGS. 15B and 15C.

Figure 4A:
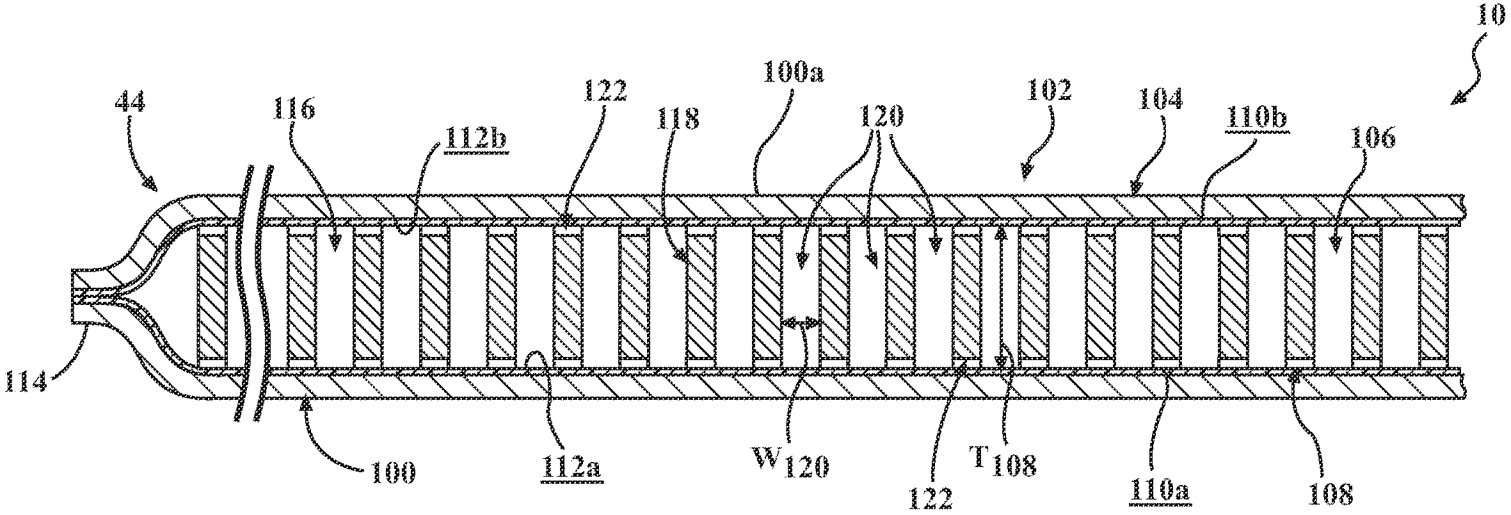
FIG. 4A is a cross-sectional view of the article of apparel of FIG. 1, taken along Line 4-4 in FIG. 1, where the article of apparel is in a relaxed state.
Figure 4B:
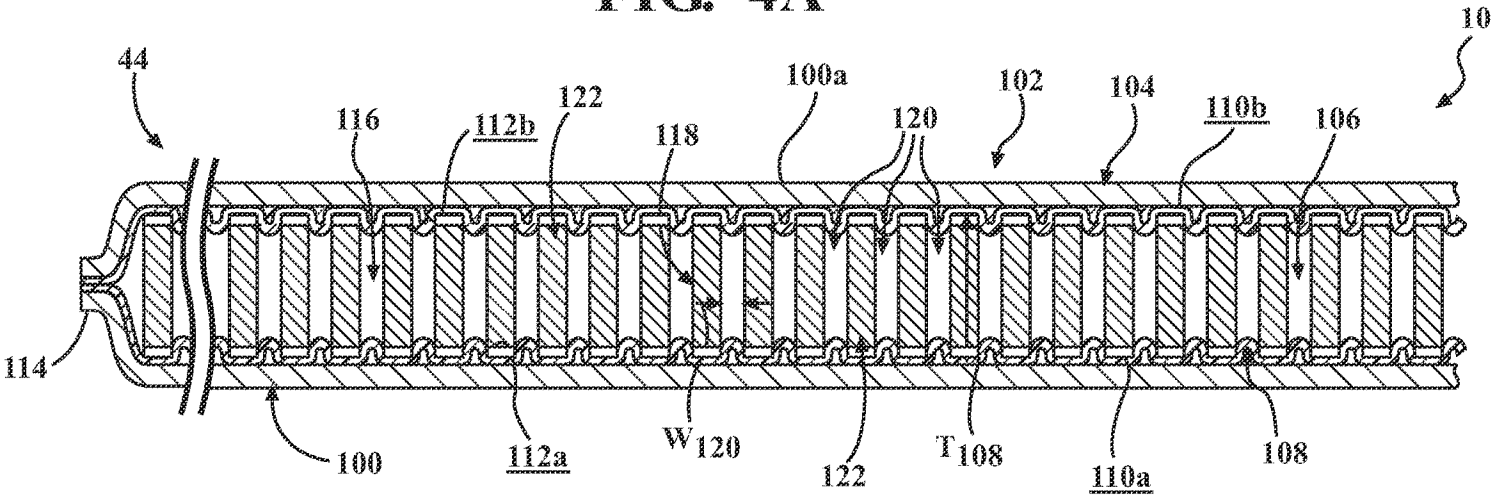
FIG. 4B is a cross-sectional view of the article of apparel of FIG. 1, taken along Line 4-4 in FIG. 1, where the article of apparel is in a constricted state.

FIGS. 4A and 4B illustrate a cross-sectional view of an example of the adjustment element 102 transitioning from the relaxed state (FIG. 4A) to the constricted state (FIG. 4B) taken along Line 4-4 of FIG. 1. As shown in FIG. 4A, the compressible component 108 includes a first surface 110*a* on a first side of the compressible component 108 and a second surface 110*b* on an opposite second side of the compressible component 108. A distance from the first surface 110*a* to the second surface 110*b* has a thickness $T_{108}$ of the compressible component 108. For example, the thickness $T_{108}$ of the compressible component 108 may be approximately 6 millimeters. It is also contemplated that the compressible component 108 may have a thickness ranging from approximately 2 millimeters to approximately 10 millimeters. Alternatively, the thickness $T_{108}$ may be equal to or less than 2 millimeters or greater than or equal to 10 millimeters. Additionally or alternatively, the compressible component 108 may have a varied thickness $T_{108}$ across the compressible component 108. Finally, while the compressible component 108 is described as having a thickness in the foregoing ranges, the thickness of the compressible component 108 may be dependent on the material used. As discussed in greater detail below, the compressible component 108 is operable to transition the adjustment element 102 and the bra 10 between a relaxed state (FIG. 17A) and a constricted state (FIG. 17B), as described in more detail below.

In the illustrated examples, the adjustment element 102 includes an inner barrier layer 112*a* attached to a first surface of the lining 100, and an outer barrier layer 112*b* forming at least a portion of an exterior surface of the bra 10. Stated differently, the bladder 104 may include the outer barrier layer 112*b*, the inner barrier layer 112*a*, and the bladder space or interior void 106 therebetween. The outer barrier layer 112*b*, the inner barrier layer 112*a*, and the compressible component 108 are coupled along a perimeter of the bladder 104, as described in more detail below. Interior surfaces of the barrier layers 112*a*, 112*b* face each other and are joined to each other to form a peripheral seam 114 that surrounds the interior void 106 to form a chamber 116 of the bladder 104. The second surface 110*b* and the outer barrier layer 112*b* may be separate from each other except at the perimeter, and the first surface 110*a* and the inner barrier layer 112*a* may be separate from each other except at the perimeter.

As used herein, the term "barrier layer" (e.g., barrier layers 112*a*, 112*b*) encompasses both monolayer and multilayer films. In some configurations, one or both of barrier layers 112*a*, 112*b* are produced (e.g., thermoformed or blow molded) from a monolayer film (a single layer). In other configurations, one or both of the barrier layers 112*a*, 112*b* are produced (e.g., thermoformed or blow molded) from a multilayer film (multiple sublayers). In either aspect, each layer or sublayer can have a film thickness ranging from approximately 0.2 micrometers to approximately 1 millimeter. In further configurations, the film thickness for each layer or sublayer can range from approximately 0.5 micrometers to approximately 500 micrometers. In yet further configurations, the film thickness for each layer or sublayer can range from approximately 1 micrometer to approximately 100 micrometers.

One or both of the barrier layers 112*a*, 112*b* can independently be transparent, translucent, and/or opaque. As used herein, the term "transparent" for a barrier layer means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 112*a*, 112*b* can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like. In one example, one or both of the barrier layers 112*a*, 112*b* may include a film disposed along an outer surface of the barrier layer(s) 112*a*, 112*b* or that forms the barrier layer(s) 112*a*, 112*b*. The film may optionally be configured to tactically correspond to a textile that has the look and/or feel of a textile in terms of appearance and/or stretchability but is able to contain a fluid with the bladder 104. For example, the film may be formed from a TPU textile composite. The film may assist in fluid flow along the barrier layer(s) 112*a*, 112*b* while cooperating to retain fluid within the bra 10.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some configurations, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 112*a*, 112*b* may include two or more sublayers (multilayer film), such that two sheets of the multilayer film may be placed on top of each other and welded together along selected points using conventional heat sealing techniques of radiofrequency (RF) welding techniques to form an interior compartment. In configurations where the barrier layers 112*a*, 112*b* include two or more sublayers, examples of suitable multilayer films include microlayer films, for example a microlayer polymeric composite including at least approximately 10 layers and may range between at least approximately 10 layers to at least approximately 50 layers and/or microlayer elastomer membranes including at least approximately 10 to approximately 1000 layers. The average thickness of each individual layer may be as low as a few nanometers to as high as several mils (approximately 100 microns) thick. In further configurations, barrier layers 112*a*, 112*b* may each independently include alternating sublayers of one or more TPU copolymer materials and one or more EVOH copolymer materials, where the total number of sublayers in each of the barrier layers 112*a*, 112*b* includes at least four (4) sublayers, at least ten (10) sublayers, at least twenty (20) sublayers, at least forty (40) sublayers, and/or at least sixty (60) sublayers.

The chamber 116 can be produced from the barrier layers 112*a*, 112*b* using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 112*a*, 112*b* can be produced by coextrusion followed by vacuum thermoforming to produce the chamber 116. The chamber 116 desirably has a low gas transmission rate.

In some implementations, the inner barrier layer 112*a* and the outer barrier layer 112*b* cooperate to form a geometry (e.g., thicknesses, width, and lengths) of the chamber 116. The peripheral seam 114 may extend around the chamber 116 to seal the chamber 116 and allow a vacuum to be applied to the chamber 116. Thus, the chamber 116 is associated with an area of the bladder 104 where interior surfaces of the upper and lower barrier layers 112*a*, 112*b* are not joined together and, thus, are separated from one another. The compressible component 108 is received within the chamber 116 in areas where the barrier layers 112*a*, 112*b* are not joined together. Finally, while the peripheral seam 114 is described and shown as sealing the chamber 116, the peripheral seam 114 may also be used to attach the lining 100 to the bladder 104. Namely, a material forming the lining 100 may be fused to a material forming the barrier layer(s) 112*a*, 112*b* when the peripheral seam 114 is formed by causing a material of one or more of the barrier layers 112*a*, 112*b* to flow and, thus, bond to a material of the lining 100.

In some examples, the barrier layers 112*a*, 112*b* may include the same materials to provide the chamber 116 with a homogenous barrier construction, such that both sides of the adjustment element 102 will contract and relax at the same rate when pressure within the chamber 116 is adjusted. Alternatively, a first one of the barrier layers 112*a*, 112*b* may be at least partially constructed of a different barrier material and/or configuration than the other one of the barrier layers 112*a*, 112*b* to selectively impart a contour as the adjustment elements 102, 102*a* transition between the relaxed state and the contracted state. For example, one of the barrier layers 112*a*, 112*b* may be at least partially formed with a different modulus of elasticity and/or stiffness than the other barrier layer 112*a*, 112*b*, such that when the adjustment elements 102, 102*a* transition from the relaxed state to the constricted state, the first one of the barrier layers 112*a*, 112*b* contracts at a different rate than the other barrier layer 112*a*, 112*b* to cause the adjustment element to curl.

Continuing with reference to FIGS. 4A and 4B, the compressible component 108 forms a transformable structure that selectively moves the bra 10 between the relaxed state and the constricted state. The first surface 110*a* of the compressible component 108 faces the inner barrier layer 112*a* and the second surface 110*b* faces the outer barrier layer 112*b*. In this example, the compressible component 108 includes a collapsible lattice structure 118 having a plurality of apertures or cells or reliefs 120, described in more detail below, formed through the thickness $T_{108}$ (i.e., direction from the inner barrier layer 112*a* to the outer barrier layer 112*b*) of the compressible component 108. The plurality of reliefs 120 may have a first geometric shape and are configured to form the lattice structure 118. The compressible component is disposed within the bladder space or interior void 106 and includes the plurality of reliefs 120. It is contemplated that the lattice structure 118 may be formed from an EVA material and may be cut flat to optionally form an outline of the compressible component 108 and/or the reliefs 120. In one example, the compressible component 108 may be laser cut to form the reliefs 120, such that the heat from the laser may provide a sealing skin along the reliefs 120 to advantageously improve the structural integrity of the compressible component 108. The compressible component 108 may be subsequently thermoformed into a desired three-dimensional shape. In one example, after thermoforming, the compressible component 108 may be disposed within the interior void 106 of the adjustment element 102. In another example, the compressible component may be positioned between the barrier layers 112*a*, 112*b*, and the compressible component and the barrier layers may be coupled (e.g., welded at at least the periphery) to form the adjustable element 102. In yet another example, the compressible component 108, as well as the inner and the outer barrier layers 112*a* and 112*b* may be each thermoformed into the desired three-dimensional shape (e.g., bra cup shape) and welded all around the perimeter to form the adjustable element 102. In some examples, when it is desired to block application of vacuum to one or more restricted zones, the one or more zones of the compressible component may be bonded to both the barrier layers at the restricted zones where vacuum is not desired. For example, a material that may bond with both the compressible component and the barrier layers may be positioned at the restricted zones where vacuum is not desired, and thermally bonded to prevent air flow out of these zones. Alternatively to thermoforming, the compressible component 108 may be injection molded to obtain the desired three-dimensional shape prior to being positioned within the interior void 106, or being positioned between the barrier layers 112*a*, 112*b* and coupled at the periphery to the barrier layers 112*a*, 112*b*. Generally, when a pressure within the chamber 116 is reduced, the lattice structure 118 collapses within the chamber 116 to transition the adjustment element 102 from the relaxed or expanded state to the constricted state. For example, at a first amount of vacuum, the bladder 104 is in the first three-dimensional shape and an outer surface 110*b* is substantially smooth when the bladder 104 is in the first three-dimensional shape, and at a second amount of vacuum, the second amount of vacuum being greater than the first amount, the outer surface 110*b* has a plurality of ridges and/or depressions based on the lattice structure 118 when the bladder 104 is in the second three-dimensional shape. In one example, the first amount of vacuum is zero inHg (e.g., no vacuum). In another example, the vacuum may range between approximately 0 inHg and approximately 23 inHg.

It is contemplated that when the bra 10 is worn by the wearer, the outer surface 110*b* is substantially smooth with a generally uniform appearance when the bladder 104 is free from the vacuum compared to when the vacuum is drawn in the bladder 104 to form the plurality of ridges. Under vacuum, the bra 10 may appear to have a series of depressions that correspond with the compressed state of the lattice structure 118, which is in response to the altered configuration of the reliefs 120. In one example, the reliefs 120 may be arranged along horizontal and/or vertical axes of the support garment or bra 10. It is also contemplated that the reliefs may be arranged radially in a direction from a center of the first and/or second breast covering portion towards a periphery of the first and/or second breast covering portion.

Referring again to FIGS. 4A and 4B, the adjustment element 102 may also include a plurality of channels 122 etched or otherwise disposed along the lattice structure 118 to promote fluid movement within the chamber 116. Further, the plurality of channels 122 provide fluid movement into and out of the chamber 116. In one example, the channels 122 may extend a partial width of the relief 120, such that each channel 122 may be less than a width and/or thickness of the respective relief 120. Stated differently, a depth of each channel 122 is less than a thickness of the reliefs 120. Further, a width of each channel 122 may be less than or equal to a width of a respective wall of the relief 120 on which the channel 122 is formed. By way of example, not limitation, the channels 122 may be configured as wells having a dimension in a range between 2 millimeters (mm) by 2 mm to 0.25 mm by 0.25 mm. In one example, each channel 122 may be approximately 0.5 mm by approximately 0.5 mm. In some examples, the channel 122 dimensions may be greater or lesser based on a type and/or thickness of compressible material used. Further, in some examples, a channel depth may be greater than a channel width or vice-versa.

The channels 122 may be positioned along the first and/or second surface 110*a*, 110*b* and include a fluid path within the chamber 116. For example, the channels 122 may extend between the reliefs 120 to fluidly connect each of the reliefs 120. It is also contemplated that the channels 122 may extend around a periphery of the compressible component 108 to provide peripheral fluid paths and promote airflow and circulation within the chamber 116. In one example, the channels 122 may be formed using a laser etching process prior to thermoforming the compressible component 108. The laser etching process may form the channels 122 into the compressible component 108 and, as a result, promote fluid flow within the bra 10 by increasing fluid circulation between the reliefs 120. For example, as mentioned below, the compressible component 108 may include an elastomeric material, such as an ethylene-vinyl acetate foam (EVA), such that the channels 122 provide fluid flow through an otherwise non-porous material. The laser etching process for forming the channels 122 may be performed at a lower power than the laser cutting process for forming the reliefs 120.

Figure 5A:
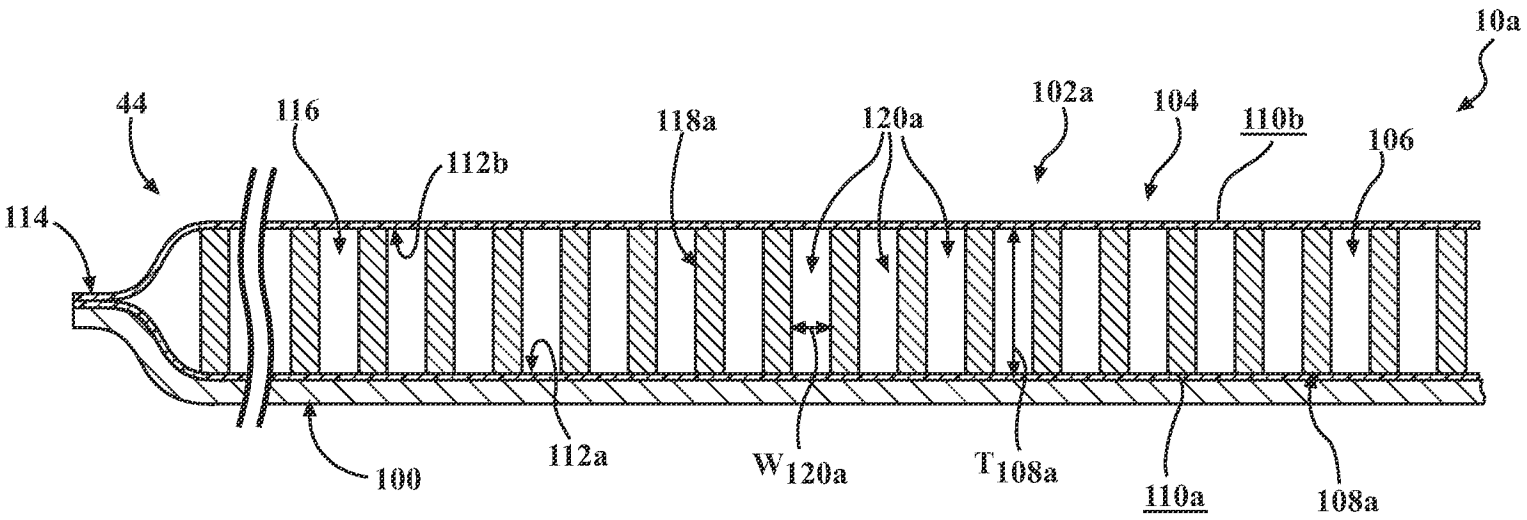
FIG. 5A is a cross-sectional view of the article of apparel of FIG. 2, taken along Line 5-5 in FIG. 2, where the article of apparel is in a relaxed state.
Figure 5B:
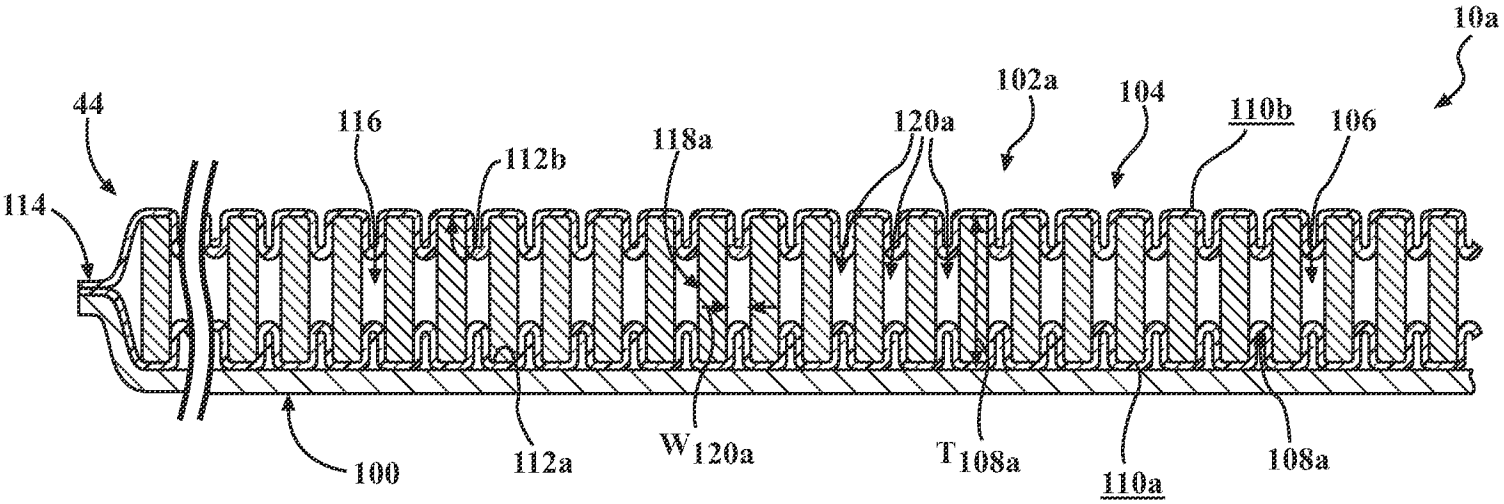
FIG. 5B is a cross-sectional view of the article of apparel of FIG. 2, taken along Line 5-5 in FIG. 2, where the article of apparel is in a constricted state.

FIGS. 5A and 5B illustrate a cross-sectional view of an example of the adjustment element 102*a* transitioning from the relaxed state (FIG. 5A) to the constricted state (FIG. 5B) taken along Line 5-5 of FIG. 2. In view of the substantial similarity in structure and function of the components associated with the adjustment element 102, like reference numerals are used hereinafter and in the drawings to identify like components while like reference numerals containing letter extensions are used to identify those components that have been modified.

The adjustment element 102*a* may be integrated in the front panel 44 of the bra 10*a* (FIG. 2) and includes a bladder 104 forming a bladder space or interior void 106 having a compressible component or infill 108*a* disposed therein. As shown in FIG. 5A, the compressible component 108*a* includes a first surface 110*a* on a first side of the compressible component 108*a* and a second surface 110*b* on an opposite second side of the compressible component 108*a*. A distance from the first surface 110*a* to the second surface 110*b* has a thickness $T_{108a}$ of the compressible component 108*a*. For example, the thickness Tim of the compressible component 108*a* may be approximately 6 millimeters. It is also contemplated that the compressible component 108*a* may have a thickness ranging from approximately 2 millimeters to approximately 10 millimeters. Alternatively, the thickness Tim may be equal to or less than 2 millimeters or greater than or equal to 10 millimeters. Additionally or alternatively, the compressible component 108*a* may have a varied thickness $T_{108a}$ across the compressible component 108*a*. Finally, while the compressible component 108*a* is described as having a thickness in the foregoing ranges, the thickness of the compressible component 108*a* may be dependent on the material used. As discussed in greater detail below, the compressible component 108*a* selectively transitions the adjustment element 102*a* and the bra 10*a* between a relaxed state (FIG. 18A) and a constricted state (FIG. 18B) to adjust a fit of the bra 10*a* around a torso of a wearer.

In the illustrated examples, the adjustment element 102*a* includes an inner barrier layer 112*a* attached to a first surface of the lining 100, and an outer barrier layer 112*b* forming at least a portion of an exterior surface of the bra 10*a*. Stated differently, the bladder 104 may include the outer barrier layer 112*b*, the inner barrier layer 112*a*, and the bladder space or interior void 106 therebetween. Interior surfaces of the barrier layers 112*a*, 112*b* face each other and are joined to each other to form a peripheral seam 114 that surrounds the interior void 106 to form a chamber 116 of the bladder 104.

In this example, the compressible component 108*a* includes a collapsible lattice structure 118*a* having a plurality of apertures or reliefs 120*a* formed through the thickness $T_{108a}$ (i.e., direction from the inner barrier layer 112*a* to the outer barrier layer 112*b*) of the compressible component 108*a*. The compressible component 108*a* may be cut flat (e.g., laser cut) to form an outline of the compressible component 108*a* and/or the reliefs 120*a*. The compressible component illustrated in FIGS. 5A and 5B is free from the channels 122, such that the lattice structure 118*a* of the compressible component 108*a* may be free from peripheral fluid paths. In this alternate configuration, it is contemplated that the compressible component 108*a* may be formed from a porous material that assists in fluid flow and circulation within the chamber 116. As the adjustment element 102*a* collapses (FIG. 5B), the outer barrier layer 112*b* may be drawn into the reliefs 120*a* towards the inner barrier layer 112*a*. Optionally, the outer barrier layer 112*b* may contact the inner barrier layer 112*a* such that friction between the inner barrier layer 112*a* and the outer barrier layer 112*b* causes the lining 100 of the front panel 44 to increase in stiffness when the adjustment element 102*a* is in the constricted state.

As the bra 10 is evacuated, the barrier layers 112*a*, 112*b* are drawn against the compressible component 108 and are generally constricted as a result of increase in vacuum. For example, as illustrated in FIGS. 4B and 5B, the barrier layers 112*a*, 112*b* may be at least partially depressed within or otherwise at least partially disposed within the reliefs 120, 120*a* defined by the lattice structures 118, 118*a* as the vacuum is drawn and the compressible components 108, 108*a* are translated into the contracted state. If the compressible component 108, 108 includes channels 122, the overall size and depth of the channels 122 is relatively small when compared to the size of the reliefs 120, 120*a*. As such, the barrier layers 112*a*, 112*b* may not extend into the channels 122 when a vacuum is drawn.

As described herein, the adjustment elements 102, 102*a* include the compressible components 108, 108*a*, respectively, which are formed in part by the lattice structures 118, 118*a*. The lattice structures 118, 118*a* include the reliefs 120, 120*a* that are configured to collapse or otherwise constrict under the vacuum. Stated differently, the lattice structures 118, 118*a* of the compressible components 108, 108*a* change as the at least partial vacuum is drawn, such that the reliefs 120, 120*a* may reduce in overall size to form a more rigid structure.

As the vacuum is drawn, fluid (e.g., air) is removed from the bladder 104 and the reliefs 120, 120*a* of the lattice structures 118, 118*a* are compressed along the x-axis while simultaneously expanding along the y-axis. With respect to the adjustment elements 102, 102*a*, the vacuum is drawn within the bladder 104, which results in the constriction of the lattice structures 118, 118*a* as a result of the vertical expansion and horizontal contraction of the reliefs 120, 120*a*. As a result of the constriction of the lattice structures 118, 118*a*, it is contemplated that the adjustment elements 102, 102*a* as a whole, including the barrier layers 112*a*, 112*b*, may be reduce in height along a z-axis as a result of the vacuum defined within the bladder 104. Stated differently, the three dimensional adjustment of the adjustment elements 102, 102*a* is achieved as a result of the vacuum drawn within the bladder 104 to alter the configuration of the reliefs 120, 120*a*. The lattice structures 118, 118*a* may thus be constricted to generally restrict a chest of the wearer to minimize movement and provide advantageous compression. In one example, a volume of the adjustable element decreases responsive to increase in vacuum within the bladder. As a non-limiting example, a volume of a bra cup is decreased responsive to application of vacuum. For example, a larger bra cup size may transition to a smaller bra cup size responsive to application of vacuum. Further, a wearer may adjust an amount of vacuum based on a desired compression or tightness. As a result, the amount of compression or tightness of the bra 10, 10*a* relative to the wearer is greater as the vacuum is applied to the adjustment element 102, 102*a* compared to when the vacuum is released.

The lattice structures 118, 118*a* also provide a three-dimensional structure that assists in the compressive movement as the compressible components 108, 108*a* translate from the relaxed state to the constricted state. The multi-directional compression maximizes the amount of constriction and, thus, support for the wearer. Stated differently, the lattice structures 118, 118*a* of the compressible components 108, 108*a* advantageously translate along each of an x- and y-axis to provide a maximum desired compressive force for the wearer, which assists in further supporting the wearer when the compressible components 108, 108*a* are in the constricted state. As illustrated in FIGS. 4A-5B, while the overall size of the compressible components 108, 108*a* and lattice structures 118, 118*a* are compressed and reduced, it is contemplated that the individual reliefs 120, 120*a* when configured as a diamond shaped relief, may simultaneously shrink or otherwise be compressed along the x-axis (that is, short diagonal) and elongated along the y-axis (that is, long diagonal).

Referring again to FIGS. 4A and 4B, the compressible component 108 may be attached along a perimeter to the corresponding barrier layer 112*a*, 112*b* when the adjustment element 102 is assembled to form the peripheral seam 114 of the adjustment element 102. Stated differently, the surfaces 110*a*, 110*b* of the compressible component 108 may be attached to the barrier layer(s) 112*a*, 112*b* along the peripheral seam 114 to form the chamber 116 of the bladder 104, as mentioned above, while being otherwise generally free from attachment. As illustrated in FIG. 4B, it is contemplated that the surfaces 110*a*, 110*b* may be drawn toward the barrier layers 112*a*, 112*b* when the adjustment element 102 is compressed under vacuum. While the surfaces 110*a*, 110*b* may be proximate or otherwise engaged with the barrier layers 112*a*, 112*b* when the vacuum is drawn, the surfaces 110*a*, 110*b* may remain otherwise unattached relative to the barrier layers 112*a*, 112*b* at areas other than the peripheral seam 114. It is also contemplated that the surfaces 110*a*, 110*b* may be spot welded or bonded with the barrier layers 112*a*, 112*b* to form portions of the compressible component 108 that may be static or otherwise free from constriction as a result of the vacuum applied, as described with respect to FIGS. 7-14 below. Thus, as the vacuum is applied the compressible component 108 moves from the relaxed state to the constricted state, and the barrier layers 112*a*, 112*b* also transition from the relaxed state to the constricted state. While the surfaces 110*a*, 110*b* may be attached to the barrier layers 112*a*, 112*b* at the peripheral seam 114, it is contemplated that the surfaces 110*a*, 110*b* may be otherwise unattached from the barrier layers 112*a*, 112*b* to provide fluid flow within the bladder 104 between the surfaces 110*a*, 110*b* and the barrier layers 112*a*, 112*b*. The adjustment element 102 also includes the channels 122, such that the barrier layers 112*a*, 112*b* have at least partial separation from the compressible component 108 even in the constricted state. The partial separation provided by the channels 122 between the barrier layers 112*a*, 112*b* and the compressible component 108 assists in fluid flow within the chamber 116.

For example, one or both of the surfaces 110*a*, 110*b* of the compressible component 108 may be detached from the barrier layers 112*a*, 112*b*. In this configuration, one or both of the barrier layers 112*a*, 112*b* are free to slide with respect to the surfaces 110*a*, 110*b* of the compressible component 108 as the compressible component 108 transitions between the relaxed state and the constricted state. For example, the barrier layers 112*a*, 112*b* are moved from the relaxed state to the constricted state when the barrier layers 112*a*, 112*b* are drawn into the reliefs 120, 120*a* under vacuum and are essentially pinched within the reliefs 120, 120*a*. In so doing, the pinched barrier layers 112*a*, 112*b* are essentially fixed for movement with the compressible component 108 due to being pinched within the reliefs 120, 120*a* and are transitioned into the constricted state along with the compressible component 108. When the vacuum is released, the resilient nature of the compressible component 108 returns the compressible component 108 to the relaxed or expanded state and, in so doing, exerts a force on the barrier layers 112*a*, 112*b*, thereby moving the barrier layers 112*a*, 112*b* from the constricted state to the relaxed or expanded state. The detachment or separation between the barrier layers 112*a*, 112*b* and the compressible component 108 may provide additional movement and flexibility of the bra 10 while in the relaxed state while still causing movement of the barrier layers 112*a*, 112*b* along with the compressible component 108 when the compressible component 108 is moved between the relaxed and constricted states. In some embodiments, one of the barrier layers 112*a*, 112*b* may be bonded to a corresponding layer 110*a*, 110*b* of the compressible component 108. During repeated contraction and relaxation, the outer and/or inner barrier layer 112*b*, 112*a* may not align with the corresponding surface 110*b*, 110*a* of the compressible component 108, which may cause a wrinkling appearance. In order to reduce movement of the outer barrier layer 112*b* or the inner barrier layer 112*a* with respect to the compressible component 108, the outer barrier layer 112*b* or the inner barrier layer 112*a* may be bonded to the compressible component 108. As a result, air flow through the plurality of channels occurs only via the side of the compressible component 108 that is not bonded to the barrier layer 112*a* or 112*b*.

In other implementations, at least one of the surfaces 110*a*, 110*b* of the compressible component 108 may be partially attached to the barrier layers 112*a*, 112*b*. For example, the compressible component 108 may be attached to the barrier layers 112*a*, 112*b* along a periphery of the surfaces 110*a*, 110*b* such that the interior region of the respective surface 110*a*, 110*b* is detached or independent from the barrier layers 112*a*, 112*b*. Thus, as the vacuum is applied and the compressible component 108 transitions from the relaxed state to the constricted state, the barrier layers 112*a*, 112*b* are influenced from the relaxed state to the constricted state under the applied vacuum by the outer periphery of the compressible component 108. For example, the barrier layers 112*a*, 112*b* may be attached to the compressible component 108 at the outer periphery or peripheral edge 114 of the compressible component 108. As such, when the vacuum is applied and the compressible component 108 translates toward the constricted state, the barrier layers 112*a*, 112*b* are drawn or otherwise compressed toward the compressible component 108 as a result of shrinkage or other compressive movement under vacuum of the outer periphery of the compressible component 108. Alternatively, at least one of the surfaces 110*a*, 110*b* of the compressible component 108 may be zonally attached to a respective one of the barrier layers 112*a*, 112*b*, which may then translate the surfaces 110*a*, 110*b* and the barrier layers 112*a*, 112*b* when the vacuum is drawn.

In FIG. 4A, the adjustment element 102 is in the relaxed state. As shown, the lattice structure 118 within the adjustment element 102 is expanded such that the reliefs 120 of the lattice structure 118 have a first width $W_{120}$. To move the adjustment element 102 to the constricted state, pressure within the interior void 106 of the adjustment element 102 is reduced until a vacuum force overcomes the opposing biasing force imparted by the resilient material of the compressible component 108 and collapses the lattice structure 118 at the reliefs 120, transitioning the reliefs 120 from the expanded width $W_{120}$ to a collapsed width $W_{120}$.

Figure 6:
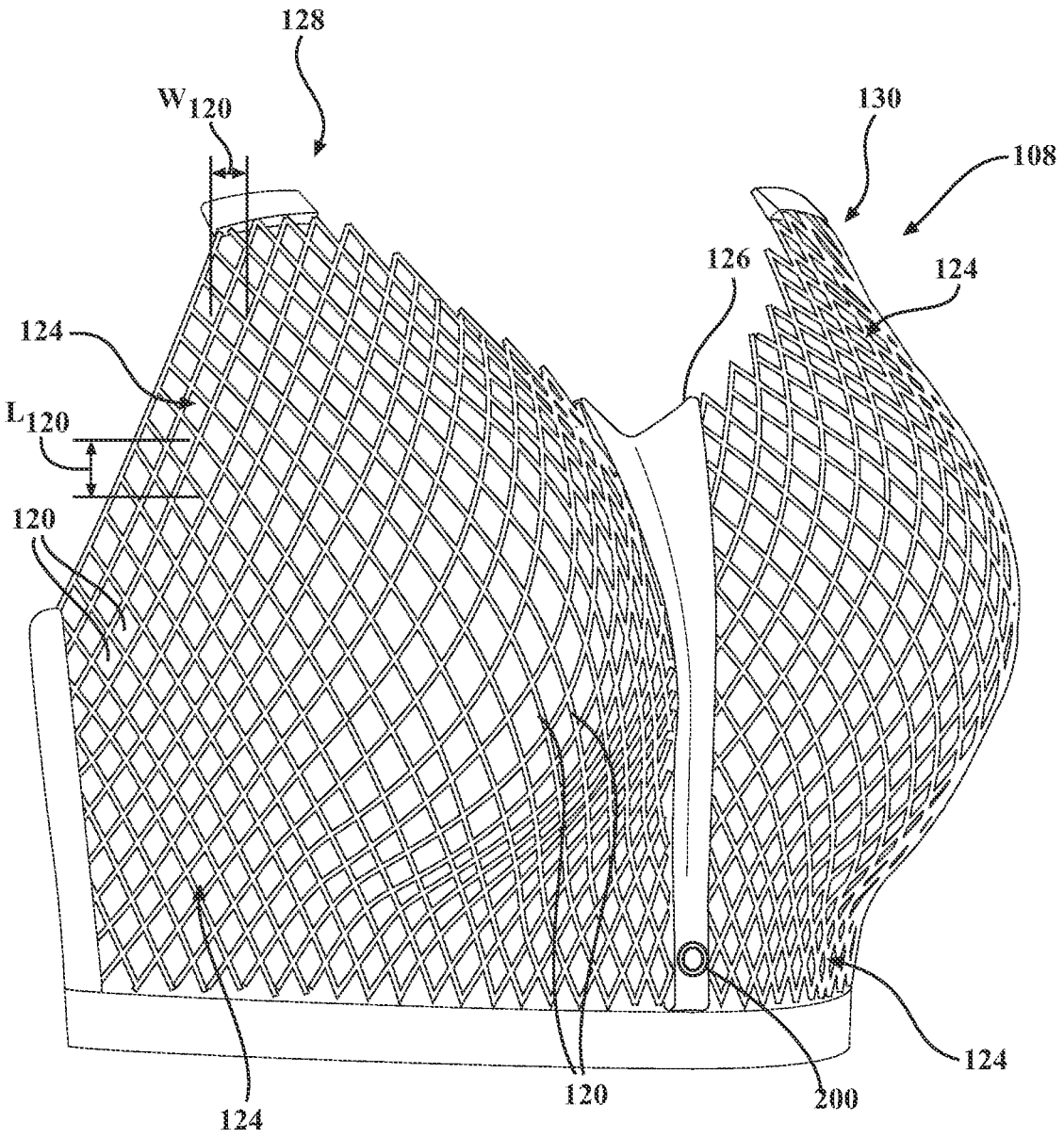
FIG. 6 is a perspective view of a compressible component according to the present disclosure, where the compressible component is in a relaxed state.

Referring now to FIG. 6, the reliefs 120 of the compressible component 108 may include various structures including, but not limited to, diamond, wave, egg crate, and/or radial configuration, as described in more detail below. Each relief 120 includes an opening defined by relief walls surrounding a perimeter of the opening. For example, a parallelogram shaped relief comprises a parallelogram shaped opening defined by four side walls. For instance, reliefs 120 may be rectangular or parallelogram-shaped reliefs 120 including a length $L_{120}$ extending across a first pair of opposing corners and a width $W_{120}$ extending across a second pair of opposing corners that are arranged transverse (e.g., perpendicular) to the length $L_{120}$. The compressible component 108 may include a single adjustment zone 124, such that the lattice structure 118 may uniformly adjust during application of the vacuum to the compressible component. In particular, the compressible component 108 may include a uniform lattice structure 118, such that each of the plurality of reliefs 120 that form the lattice structure 118 may have the same size. Additionally or alternatively, the lattice structure 118 may have variable adjustment depending on the fit of the bra 10 relative to the wearer. Stated differently and as described in more detail below, portions of the lattice structure 118 may be adjusted independently relative to other portions of the lattice structure 118 depending on the fit of the bra 10 relative to the wearer. For example, the perimeter cup region 54 may be adjusted independently of the central cup region 52. The compressible component 108 may further include a central element 126 corresponding to the center bridge 48 (FIG. 1) generally dividing the compressible component 108 into a right side 128 and a left side 130 corresponding to the right panel 46 and the left panel 50 of the front panel 44.

In the illustrated example, the width $W_{120}$ of each relief 120 is less than the length Lim such that the reliefs 120 are configured to collapse along the widthwise direction when the pressure is reduced within the chamber 116 (FIG. 4B). Accordingly, orientations of the reliefs 120 may be selected depending on a desired transition profile between the expanded state and the constricted state. For example, the aspect ratio may be approximately 10 millimeters by approximately 15 millimeters. Alternatively, the aspect ratio of the reliefs 120 may be greater than approximately 10 millimeters by approximately 15 millimeters or may be less than approximately 10 millimeters by approximately 15 millimeters. The aspect ratio of the reliefs 120 may be generally dependent on the configuration, dimensions, and general shape of the reliefs 120, such that a range of aspect ratios is contemplated for the reliefs 120. Each of the reliefs 120 may be vertically aligned to form the compressible component 108, as illustrated in FIG. 6.

In one example, the reliefs 120 may have a generally diamond shape, as mentioned above. The diamond shape of the reliefs 120 may be any configuration, such that the reliefs may be narrow, large, small, wide, thin, square, rectangular, and/or any diamond shape. It is contemplated that the reliefs 120 may shrink along the x-axis and elongate along the y-axis during translation from the relaxed state to the constricted state. The percent shrinkage of the reliefs 120 along the x-axis may be between approximately 0.05 percent and approximately 62 percent, depending on the configuration of the reliefs 120. For example, the x-axis dimensions of the reliefs 120 may shrink as the vacuum within the bladder 104 (FIG. 4A) is increased. In one example, the x-axis dimensions of the reliefs 120 may shrink from approximately 160 millimeters to approximately 60 millimeters as the vacuum pressure is increased from 0 inches of mercury (inHg) to approximately 20 inHg. It is also contemplated that the percent elongation of the reliefs 120 along the y-axis may be between approximately 0.5 percent and approximately 15 percent.

Figure 7:
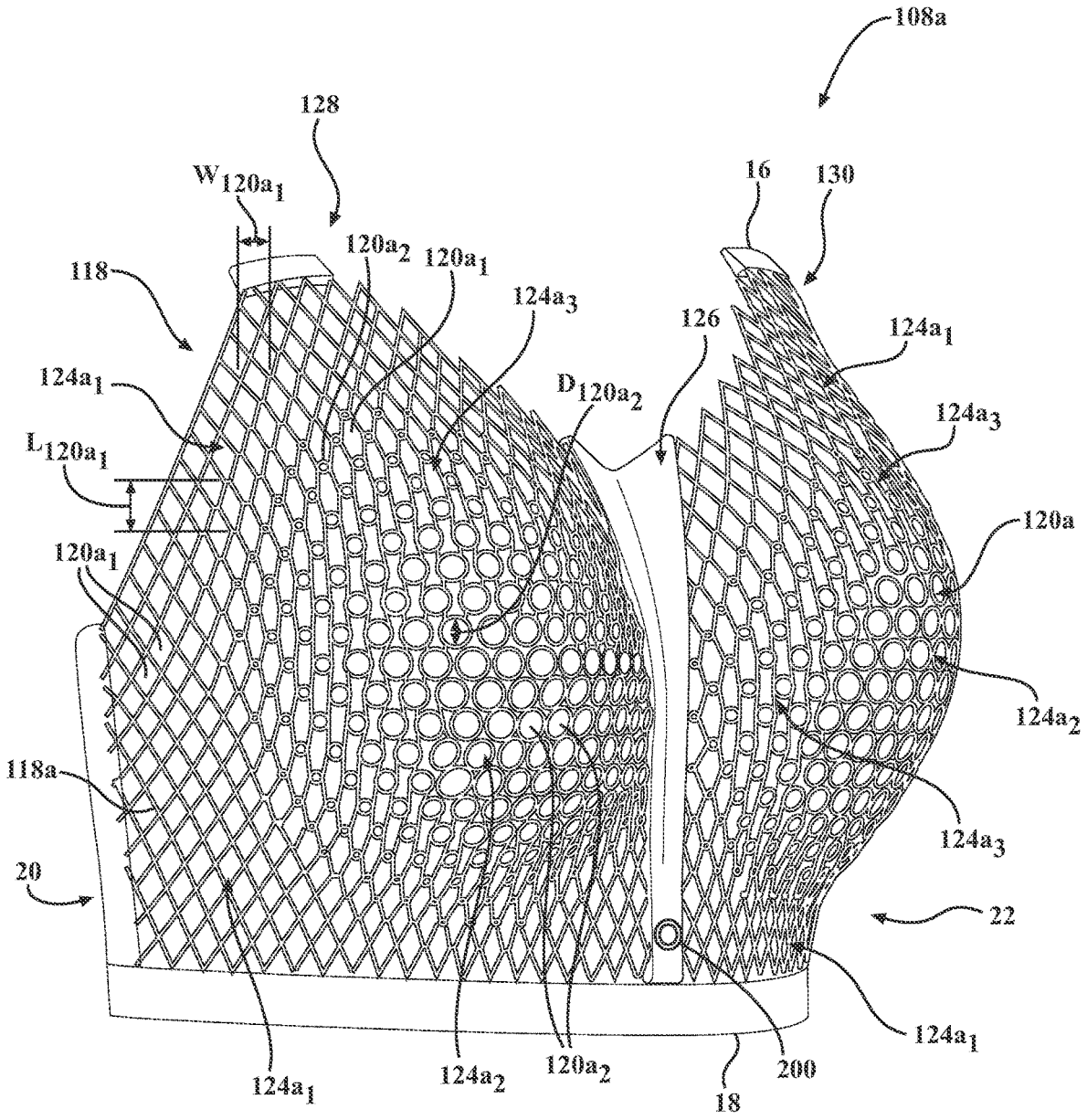
FIG. 7 is a perspective view of another example of a compressible component according to the present disclosure, where the compressible component is in a relaxed state and has a plurality of adjustment zones.

Referring now to FIG. 7, the reliefs 120*a* of the compressible component 108*a* may be formed to include polygonal-shaped or circle-shaped apertures extending through the thickness $T_{108a}$ (FIG. 5A) of the compressible component 108*a*. As mentioned above, the compressible component 108*a* includes the lattice structure 118*a* including the plurality of reliefs 120*a*. For instance, reliefs $\mathbf{120}a_1$ may be rectangular, diamond, parallelogram, or polygonal-shaped reliefs $\mathbf{120}a_1$ including a length $L_{120a1}$ extending across a first pair of opposing corners and a width $W_{120a1}$ extending across a second pair of opposing corners that are arranged transverse (e.g., perpendicular) to the length $L_{120a1}$. In the illustrated example, the width $W_{120a1}$ of each relief $\mathbf{120}a_1$ is less than the length $L_{120a1}$ such that the reliefs $\mathbf{120}a_1$ are configured to collapse along the widthwise direction when the pressure is reduced within the chamber 116. Accordingly, orientations of the reliefs $\mathbf{120}a_1$ may be selected depending on a desired transition between the expanded state and the constricted state.

The reliefs 120*a* may further include circular or generally circle-shaped reliefs $\mathbf{120}a_2$ having a diameter $D_{120a2}$. In the illustrated example, the circle-shaped reliefs $\mathbf{120}a_2$ are not configured to collapse when the pressure is reduced within the chamber 116 (FIG. 5B). The circle-shaped reliefs $\mathbf{120}a_2$ may remain passive under the vacuum, compared to the contraction of the polygonal-shaped reliefs $\mathbf{120}a_1$. It is contemplated that a combination of the circle-shaped reliefs $\mathbf{120}a_2$ and the polygonal-shaped reliefs $\mathbf{120}a_1$ may be positioned to generally correspond to the transition region 56 (FIG. 2) of the bra 10*a*, described in more detail below. Stated differently, the combination of the circle-shaped and polygonal-shaped reliefs $\mathbf{120}a_2$, $\mathbf{120}a_1$ may result in a lesser degree of contraction as compared to the polygonal-shaped reliefs $\mathbf{120}a_1$ alone and a greater degree of contraction as compared to the circle-shaped reliefs $\mathbf{120}a_2$ alone. While the circle-shaped reliefs $\mathbf{120}a_2$ are generally passive, it is contemplated that the circle-shaped reliefs $\mathbf{120}a_2$ may compress minimally to draw together any potential connecting portions of the lattice structure 118*a* between the circle-shaped reliefs $\mathbf{120}a_2$. Accordingly, orientations of the reliefs $\mathbf{120}a_2$ may be selected depending on a desired location for maintaining the relaxed state or expanded state.

In the illustrated example, the reliefs 120*a* of the compressible component 108*a* are arranged in a plurality of adjustment zones $\mathbf{124}a_1$-$\mathbf{124}a_3$ to impart different transformation characteristics along the bra 10. For example, the compressible component 108*a* includes a first adjustment zone $\mathbf{124}a_1$ arranged along the perimeter cup region 54 (FIG. 2) of the front panel 44 and including an array (e.g., rows and columns) of the reliefs $\mathbf{120}a_1$ having the widths $W_{120a1}$ oriented across a transverse direction (i.e., from the right side 20 to the left side 22) of the front panel 44 and the lengths $L_{120a1}$ oriented along the longitudinal direction (i.e., from the upper end 16 to the lower end 18) of the front panel 44. Thus, the reliefs 120$a_1$ of the first adjustment zone 124$a_1$ are configured to selectively constrict the perimeter cup region 54 (FIG. 2) of the front panel 44 along the widthwise direction over the upper-torso of the wearer. The compressible component 108*a* may further include a central element 126 corresponding to the center bridge 48 (FIG. 2) and generally dividing the compressible component 108*a* into a right side 128 and a left side 130 corresponding to the right panel 46 and the left panel 50 of the front panel 44.

With continued reference to FIG. 7, the central portions of the compressible component 108*a* form a second adjustment zone 124$a_2$ arranged in the central cup region 52 of the right panel 46 and the left panel 50 of the front panel 44. The second adjustment zone 124$a_2$ includes an array of the reliefs 120$a_2$ with diameters $D_{120a2}$. The second adjustment zone 124$a_2$ is configured to create a static or passive region within the bra 10*a* where the compressible component 108*a* and the front panel 44 do not contract or contract to a lesser extent than the first adjustment zone 124$a_1$. Accordingly, the central cup region 52 maintains substantially the same shape whether the compressible component 108*a* is in the relaxed state or the contracted state. The compressible component 108*a* includes a third adjustment zone 124$a_3$ formed in the transition region 56 between the perimeter cup region 54 and the central cup region 52. Here, the reliefs 120*a* include a combination of the reliefs 120$a_1$ and 120$a_2$ oriented in an alternating arrangement. Accordingly, the third adjustment zone 124$a_3$ is configured to constrict the transition region 56 less than the perimeter cup region 54, but more than the central cup region 52 as the adjustment element 102*a* (FIG. 5A) is moved from the relaxed state to the constricted state.

Figure 8:
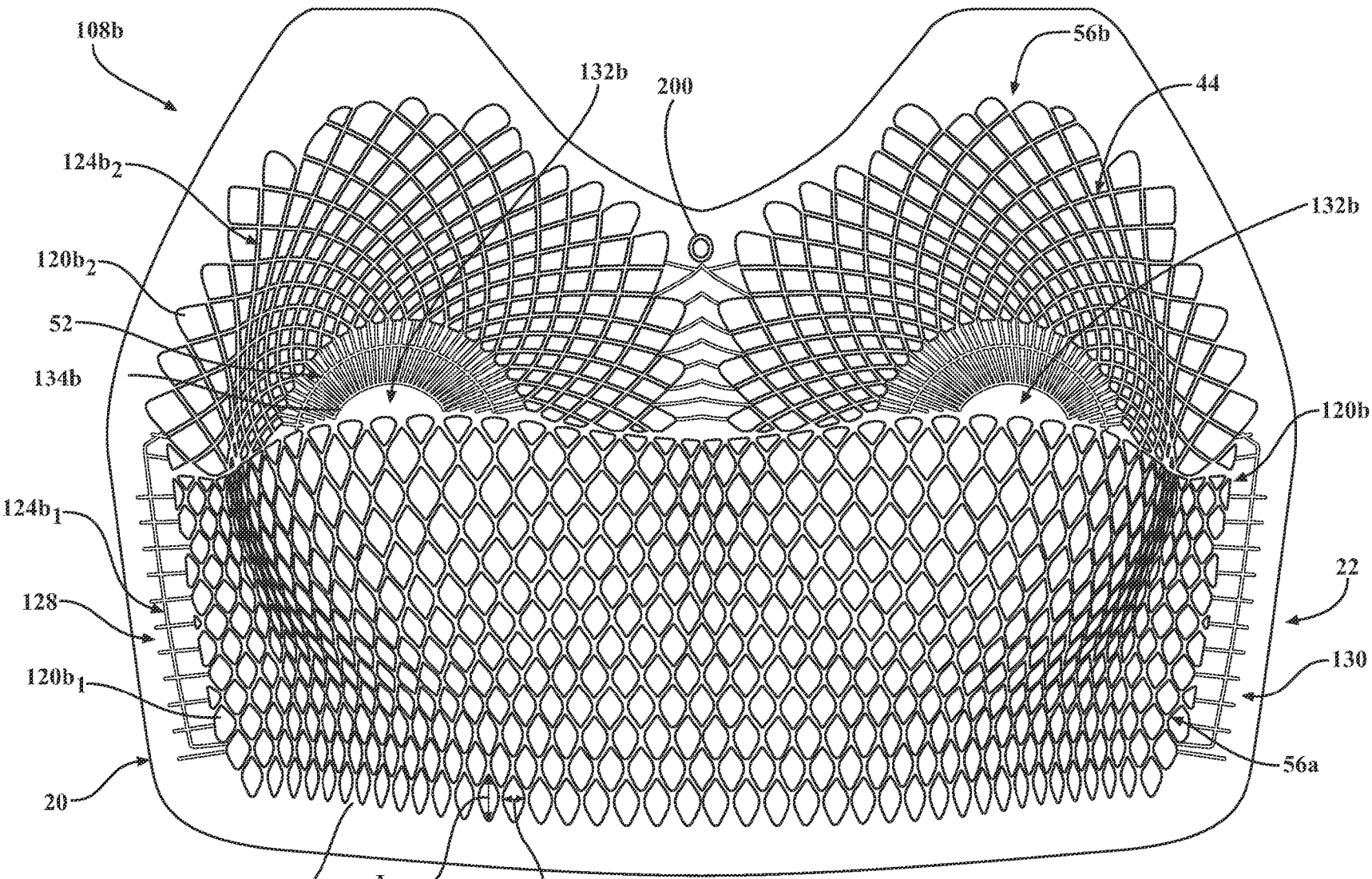
FIG. 8 is a perspective view of a compressible component according to the present disclosure, where the compressible component is in a relaxed state and has a first adjustment zone and a second adjustment zone.

With particular reference to FIG. 8, a compressible component 108*b* is provided. In view of the substantial similarity in structure and function of the components associated with the compressible component 108, like reference numerals are used hereinafter and in the drawings to identify like components while like reference numerals containing letter extensions are used to identify those components that have been modified.

In the illustrated example of FIG. 8, the compressible component 108*b* includes reliefs 120*b*, which are arranged in a plurality of adjustment zones 124$b_1$, 124$b_2$ to impart transition profiles having different transformation characteristics along the bra 10. For example, the compressible component 108*b* may include a first adjustment zone 124$b_1$ arranged along the bottom region 56*a* of the front panel 44 and including an array (e.g., rows and columns) of reliefs 120$b_1$ having widths $W_{120b1}$ oriented across the frontal direction (i.e., from the right side 20 to the left side 22) of the front panel 44 and lengths $L_{120b1}$ oriented along the longitudinal direction (i.e., from the central cup region 52 to the lower end 18) of the front panel 44. Thus, the reliefs 120$b_1$ of the first adjustment zone 124$b_1$ are configured to selectively constrict the bottom region 56*a* of the front panel 44 along the widthwise or frontal direction over the upper-torso of the wearer. The compressible component 108*b* may further include a central element 126 corresponding to the center bridge 48 and generally dividing the compressible component 108*b* into a right side 128 and a left side 130 corresponding to the right panel 46 and the left panel 50 of the front panel 44.

The compressible component 108*b* may include a second adjustment zone 124$b_2$ arranged in an upper portion of the central cup region 52 and the upper region 56*b* of the front panel 44. The second adjustment zone 124$b_2$ includes a semi-circular dead and/or static region 132*b* having a location corresponding to an upper half of an areola of a wearer and reliefs 120$b_2$ arranged radially relative to the dead region 132*b* of the central cup region 52. Stated differently, the reliefs 120$b_2$ are oriented in a transverse direction relative to the first reliefs 120$b_1$. Here, the dead and/or static region 132*b* may also be a static region free from the reliefs 120$b_2$. Accordingly, the second adjustment zone 124$b_2$ may radially constrict while the static region 132*b* of the second adjustment zone 124$b_2$ remains relaxed. Accordingly, an interior portion of the central cup region 52 may maintain substantially the same shape whether the compressible component 108*b* is in the relaxed state or the constricted state.

It is generally contemplated that the first adjustment zone 124$b_1$ and the second adjustment zone 124$b_2$ may correspond to the first and second zones, respectively, of the bladder 104 as mentioned above. The first zone 124$b_1$, the outer barrier layer 112*b* (FIG. 4A), the inner barrier layer 112*a*, and the compressible component 108*b* may be fused along a first zone perimeter or barrier 134*b*. The first zone 124$b_1$, the second surface 110*b*, and the outer layer 112*b* are separate from each other except at the first zone perimeter 134*b*, and the first surface 110*a* and the inner layer 112*a* are separate from each other except at the first zone perimeter 134*b*. At the second zone 124$b_2$, the second surface 110*b* may be fused with the outer layer 112*b* at one or more regions and the first surface 110*a* may be fused with the inner layer 112*a* at the one or more regions. Additionally or alternatively, at the second zone 124$b_2$, the second surface 110*b* may be fully fused with the outer layer 112*b* and the first surface 110*a* may be fully fused with the inner layer 112*a*.

Figure 9:
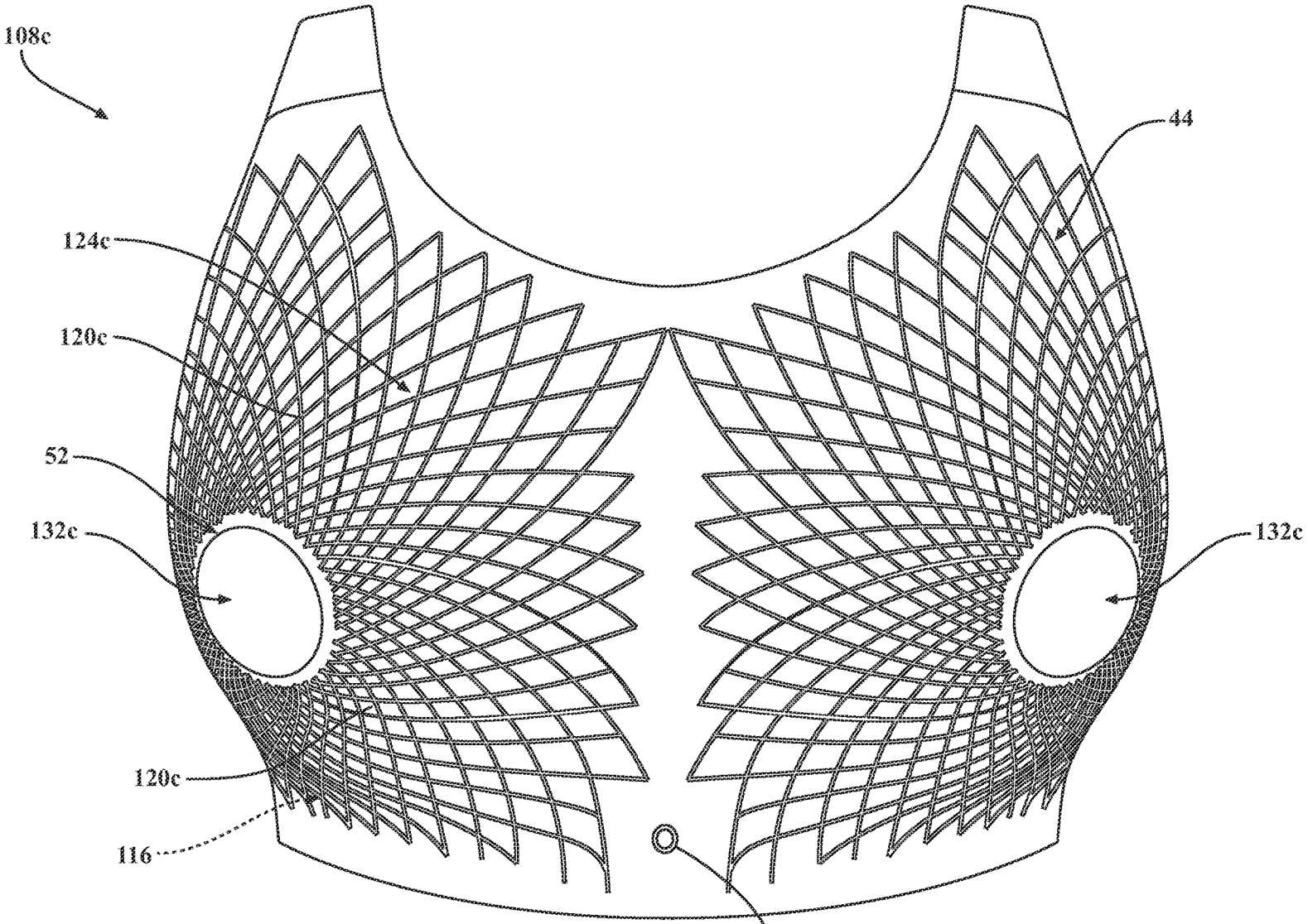
FIG. 9 is a perspective view of a compressible component according to the present disclosure, where the compressible component is in a relaxed state and has a single adjustment zone.

With particular reference to FIG. 9, a compressible component 108*c* is provided. In view of the substantial similarity in structure and function of the components associated with the compressible component 108, like reference numerals are used hereinafter and in the drawings to identify like components while like reference numerals containing letter extensions are used to identify those components that have been modified. The compressible component 108*c* illustrated in FIG. 9 includes reliefs 120*c* and a single adjustment zone 124*c* radially extending from a static region 132*c* of the central cup region 52 of the front panel 44. As mentioned with respect to FIG. 8, the static region 132*c* illustrated in FIG. 9 may remain substantially relaxed while the adjustment zone 124*c* radially constricts the reliefs 120*c* about the static region 132*c* in the constricted state of the compressible component 108*c*.

Figure 10A:
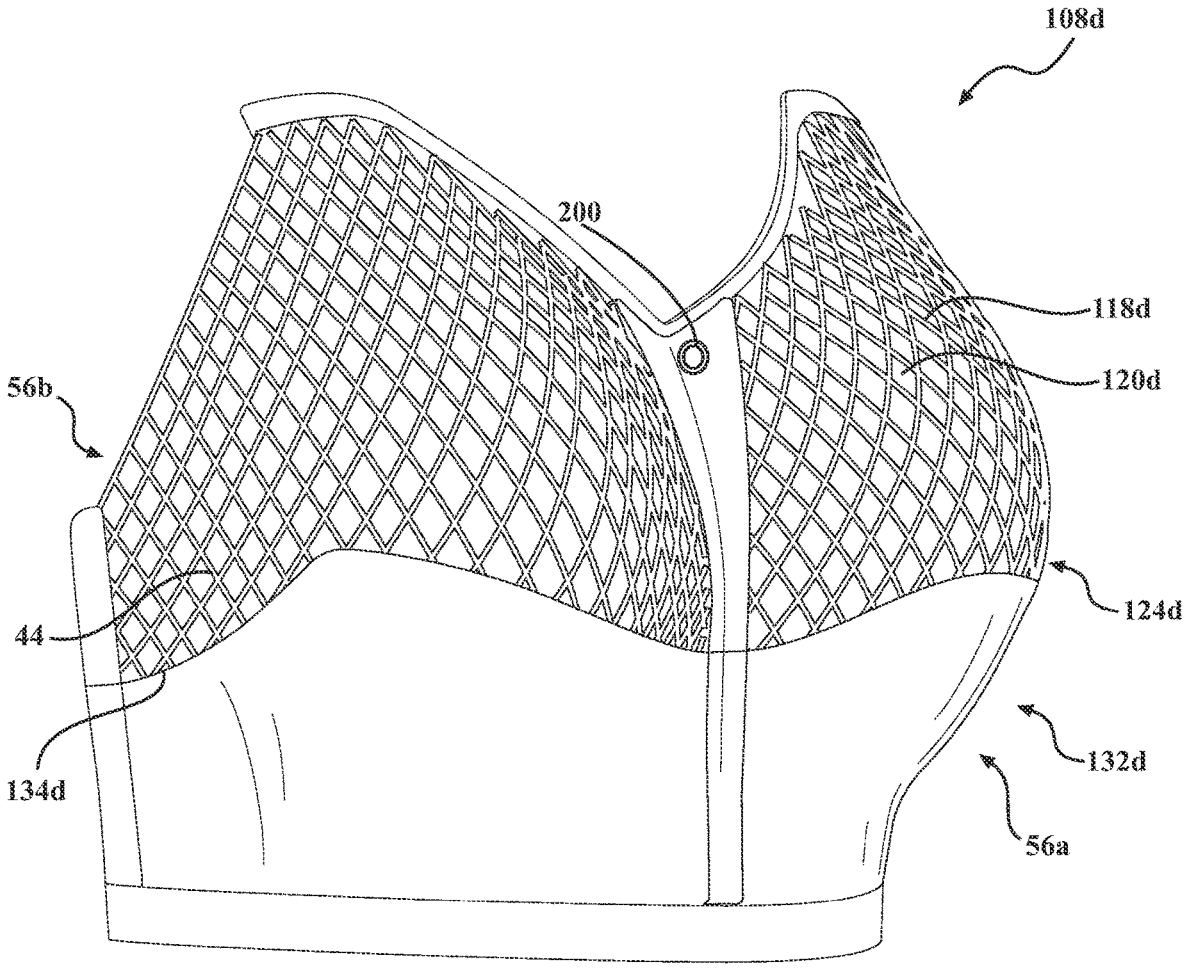
FIG. 10A is a perspective view of a compressible component according to the present disclosure, where the compressible component is in a relaxed state and has a single adjustment zone along an upper region.
Figure 10B:
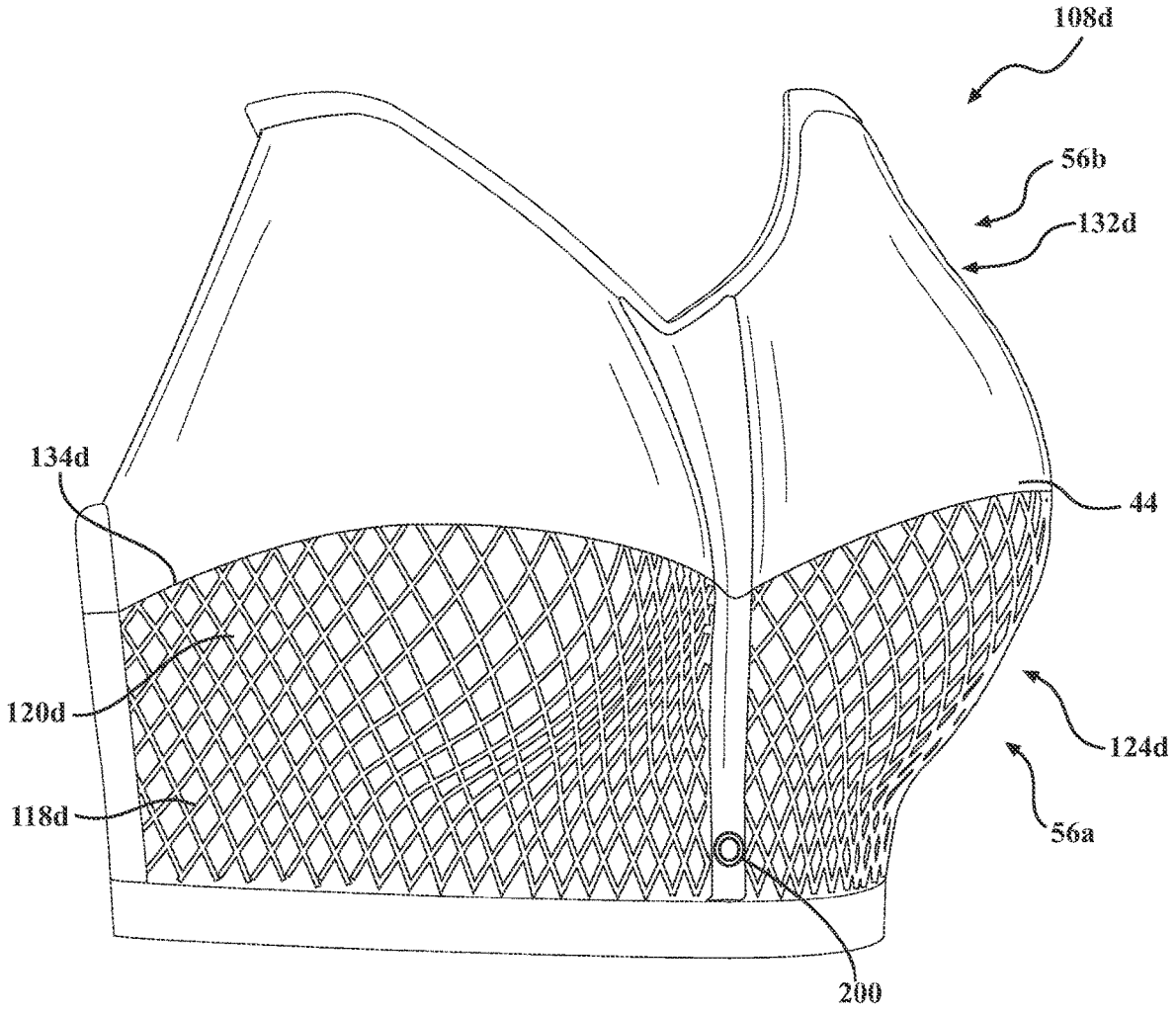
FIG. 10B is a perspective view of a compressible component according to the present disclosure, where the compressible component is in a relaxed state and has a single adjustment zone along a bottom region.
Figure 10C:
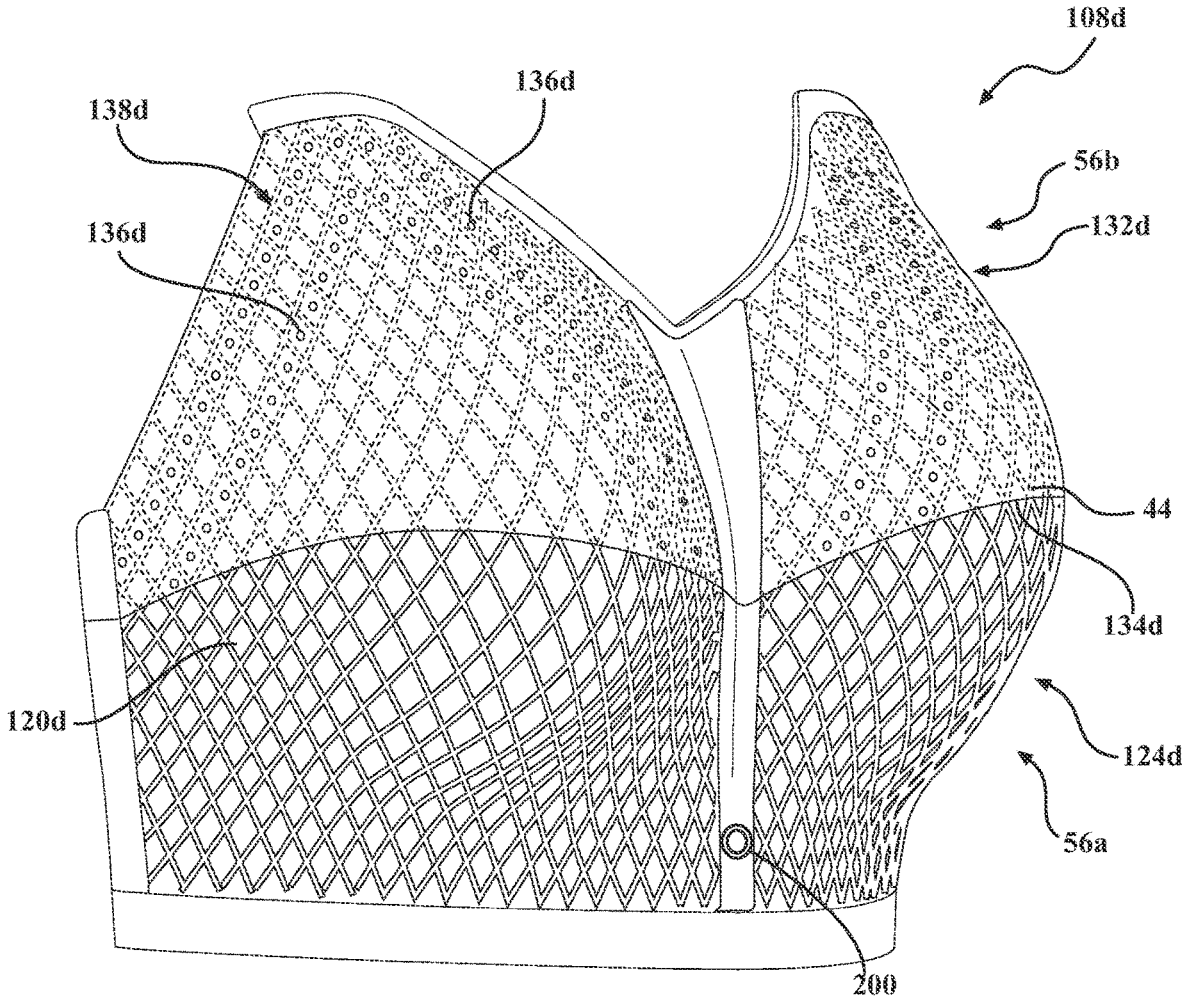
FIG. 10C is a perspective view of a compressible component according to the present disclosure, where a lattice structure of the compressible component is disposed within an adjustment zone and a static region.

With particular reference to FIGS. 10A-10C, a compressible component 108*d* is provided. In view of the substantial similarity in structure and function of the components associated with the compressible component 108, like reference numerals are used hereinafter and in the drawings to identify like components while like reference numerals containing letter extensions are used to identify those components that have been modified.

The compressible component 108*d* illustrated in FIGS. 10A-10C includes a lattice structure 118*d* with reliefs 120*d* and a single adjustment zone 124*d* extending from a static region 132*d*. The static region 132*d* illustrated in FIGS. 10A-10C may remain substantially relaxed while the adjustment zone 124*d* constricts the reliefs 120*d* about the static region 132*d* in the constricted state of the compressible component 108*d*. It is contemplated that the static region 132*d* may correspond with either the bottom region 56*a* or the upper region 56*b* of the front panel 44. For example, the static region 132*d* is illustrated in FIG. 10A along the bottom region 56*a* of the front panel 44 with the adjustment zone 124*d* formed along the upper region 56*b* of the front panel 44. Alternatively, FIG. 10B illustrates the static region 132*d* along the upper region 56*b* of the front panel 44 with the adjustment zone 124*d* formed along the bottom region 56*a* of the front panel 44. In either configuration the static region 132*d* is fluidly sealed from or otherwise impermeable relative to the adjustment zone 124*d* via a barrier 134*d*, such that when a vacuum is drawn in the adjustment zone 124*d* the static region 132*d* remains generally unaffected by the drawn vacuum and there is no fluid communication between the static region 132*d* and the adjustment zone 124*d*. Additionally or alternatively, the barrier 134*d* may be formed from an impermeable coating at a junction between the static region 132*d* and the adjustment zone 124*d*. The impermeable coating or barrier 134*d* is configured to prevent fluid communication between the static region 132*d* and the adjustment zone 124*d*.

FIG. 10C illustrates an alternate configuration of the compressible component 108*d* with the lattice structure 118*d* disposed within both the adjustment zone 124*d* and the static region 132*d* of the compressible component 108*d*. It is contemplated that the portion of the lattice structure 118*d* disposed within the static region 132*d* is free from fluid communication with the portion of the lattice structure 118*d* disposed within the adjustment zone 124*d*. In this configuration the static region 132*d* may include a plurality of apertures 136*d* within the reliefs 120*d*, such that the apertures 136*d* may provide fluid flow to advantageously promote breathability of the static region 132*d*. For example, the apertures 136*d* are illustrated along a perimeter 138*d* of the upper region 56*b* within the reliefs 120*d*. Additionally or alternatively, the apertures 136*d* may be formed along the entire static region 132*d* or in select portions other than the perimeter 138*d*. As mentioned above, the static region 132*d* is sealed from the adjustment zone 124*d* via the barrier 134*d*. The fluid flow provided by the apertures 136*d* is configured to assist in breathability of the compressible component 108*d* where the lattice structure 118*d* extends into the static region 132*d*. Where the static region 132*d* is free from the lattice structure 118*d*, it is contemplated that the static region 132*d* of the compressible component 108*d* may be formed from a breathable material. For example, the breathable material of the static region 132*d* may form-fit with the wearer while remaining flexible. By way of example, not limitation, the static region 132*d* may be formed from spandex, lycra, and other practicable materials and combinations thereof.

Figure 11:
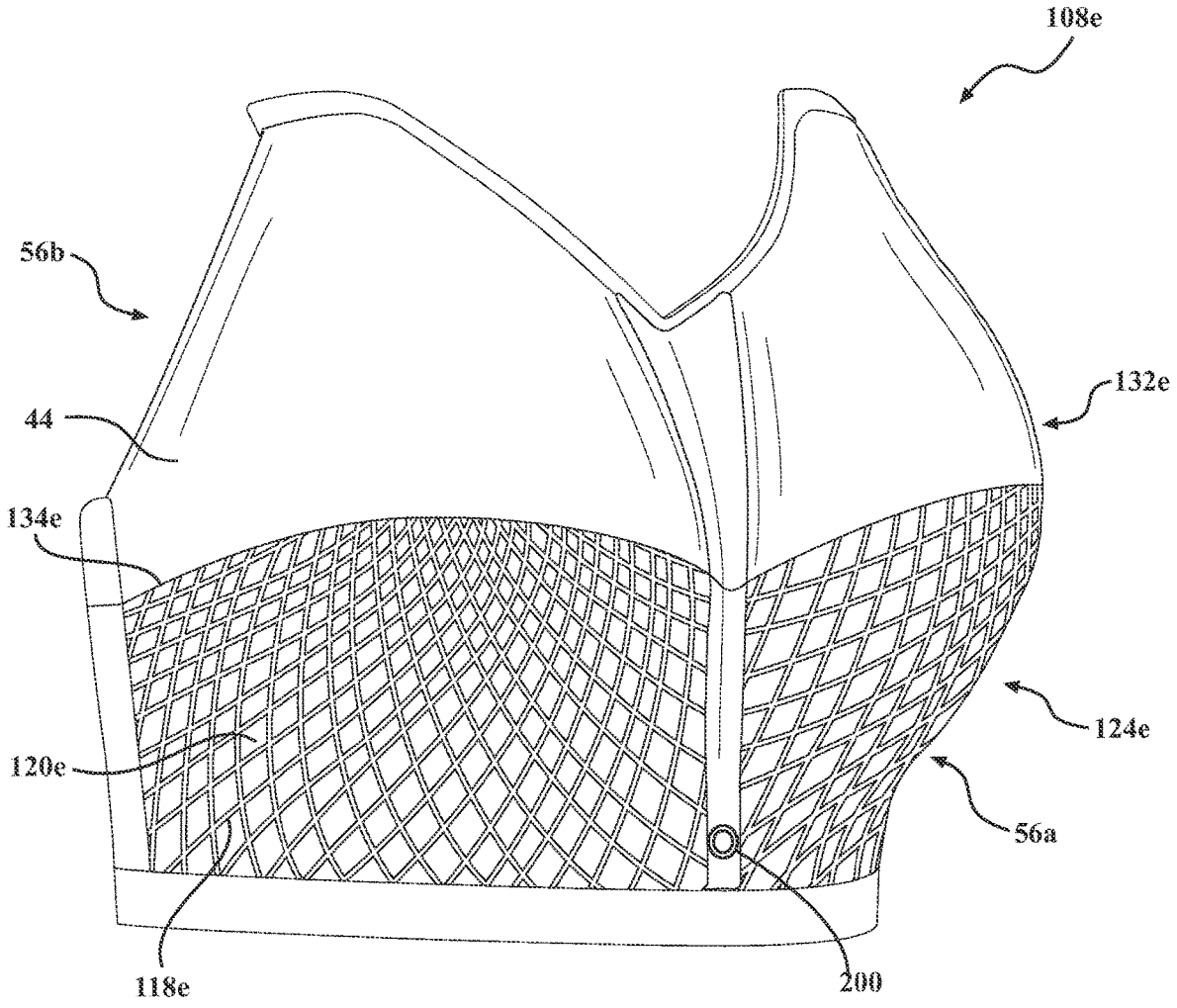
FIG. 11 is a perspective view of a compressible component according to the present disclosure, where reliefs of the compressible component are arranged in a radial orientation within an adjustment zone.

With particular reference to FIG. 11, a compressible component 108*e* is provided. In view of the substantial similarity in structure and function of the components associated with the compressible component 108, like reference numerals are used hereinafter and in the drawings to identify like components while like reference numerals containing letter extensions are used to identify those components that have been modified.

The compressible component 108*e* illustrated in FIG. 11 includes a lattice structure 118*e* including reliefs 120*e* and a single adjustment zone 124*e* extending from a static region 132*e* of the front panel 44. The reliefs 120*e* are radially oriented to form the adjustment zone 124*e*. The static region 132*e* illustrated in FIG. 11 is free from the lattice structure 118*e* and may remain substantially relaxed while the adjustment zone 124*e* radially constricts the reliefs 120*e* about the static region 132*e* in the constricted state of the compressible component 108*e*. For example, the static region 132*e* may be formed from a breathable material being form-fit with the wearer while remaining flexible. By way of example, not limitation, the static region 132*e* may be formed from spandex, lycra, and other practicable materials and combinations thereof. Alternatively, the lattice structure 118*e* may extend into the static region 132*e*, as described above with respect to FIG. 10C. In either configuration, the static region 132*e* is fluidly sealed from the adjustment zone 124*e* via a barrier 134*e* to prevent fluid communication between the adjustment zone 124*e* and the static region 132*e*. It is contemplated that the static region 132*e* may correspond with either the bottom region 56*a* or the upper region 56*b* of the front panel 44. For example, the static region 132*e* is illustrated in FIG. 11 as the bottom region 56*a* of the front panel 44 with the adjustment zone 124*e* formed along the upper region 56*b* of the front panel 44. Alternatively, the static region 132*e* may be configured as the upper region 56*b* of the front panel 44 with the adjustment zone 124*e* formed along the bottom region 56*a* of the front panel 44. The adjustment zone 124*e* is configured as radially extending from the static region 132*e*.

Figure 12:
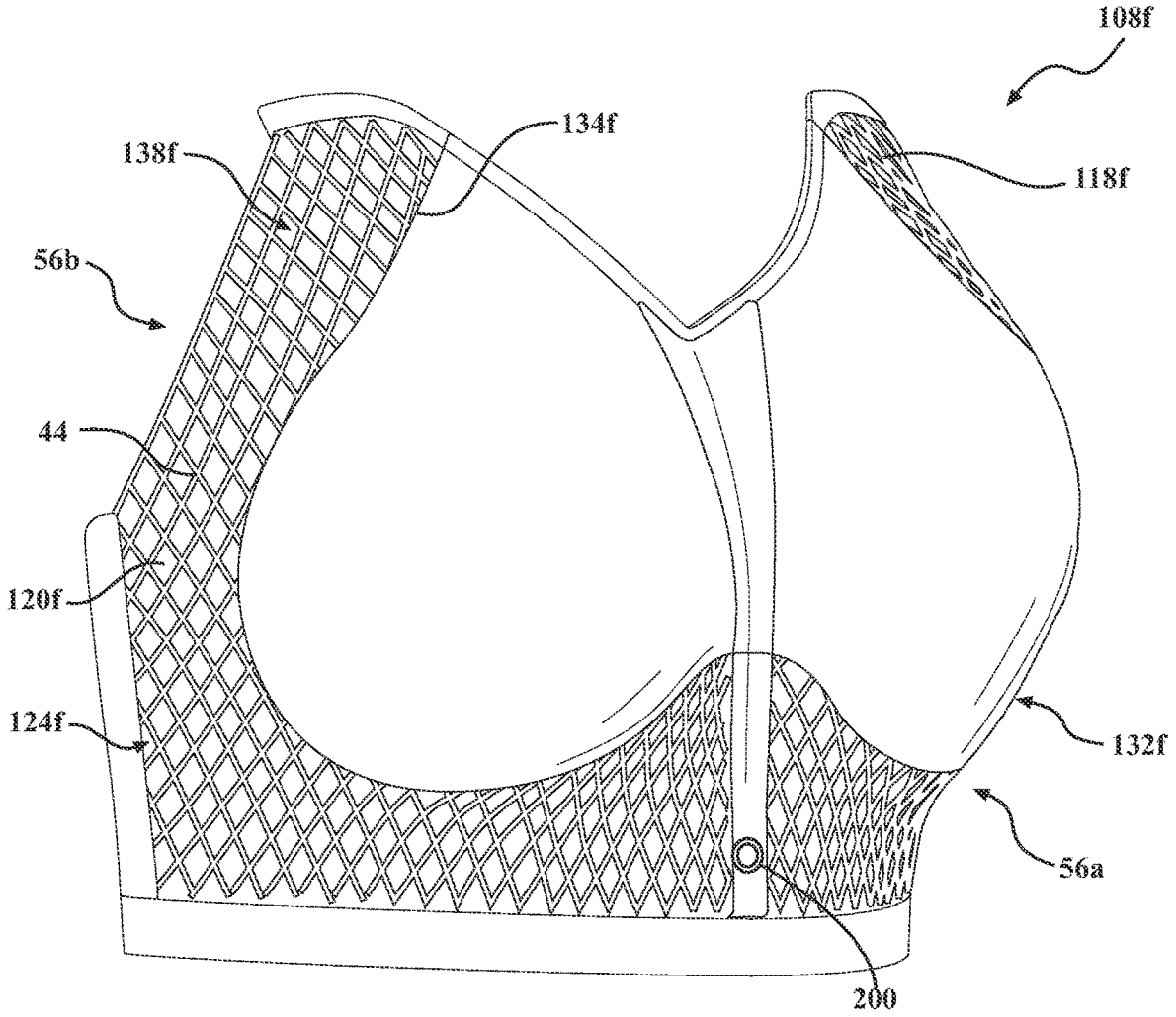
FIG. 12 is a perspective view of a compressible component according to the present disclosure, where an adjustment zone of the compressible component is disposed around a portion of a perimeter of the compressible component.

With particular reference to FIG. 12, a compressible component 108*f* is provided. In view of the substantial similarity in structure and function of the components associated with the compressible component 108, like reference numerals are used hereinafter and in the drawings to identify like components while like reference numerals containing letter extensions are used to identify those components that have been modified.

The compressible component 108*f* illustrated in FIG. 12 has an adjustment zone 124*f* disposed along a portion of a perimeter 138*f* of the compressible component 108*f*, to generally define a W-shaped configuration. Stated differently, the adjustment zone 124*f* is formed around a static region 132*f*, which generally corresponds to the central cup region 52 (FIG. 1) of the bra 10 and a portion of the upper region 56*b* of the front panel 44. It is contemplated that a lattice structure 118*f* of the compressible component 108*f* is disposed within the adjustment zone 124*f* to translate, at least in part, the adjustment zone 124*f* between a relaxed state and a constricted state, while the static region 132*f* is generally free from the lattice structure 118*f*. Alternatively, the static region 132*f* may be formed as an extension of the lattice structure 118*f*, such that the static region 132*f* may include the lattice structure 118*f*. Where the static region 132*f* is free from the lattice structure 118*f*, it is contemplated that the static region 132*f* of the compressible component 108*f* may be formed from a breathable material. For example, the static region 132*f* may be formed from a breathable material having a form-fit with the wearer while remaining flexible. By way of example, not limitation, the static region 132*f* may be formed from spandex, lycra, and other practicable materials and combinations thereof. It is generally contemplated that the static region 132*f* is fluidly sealed from or otherwise impermeable relative to the adjustment zone 124*f* via a barrier 134*f*, such that when a vacuum is drawn in the adjustment zone 124*f* the static region 132*f* remains generally unaffected by the drawn vacuum and there is no fluid communication between the static region 132*f* and the adjustment zone 124*f*. Additionally or alternatively, the barrier 134*f* may be formed from an impermeable coating at a junction between the static region 132*f* and the adjustment zone 124*f*. The impermeable coating or barrier 134*f* is configured to prevent fluid communication between the static region 132*e* and the adjustment zone 124*f*.

Figure 13A:
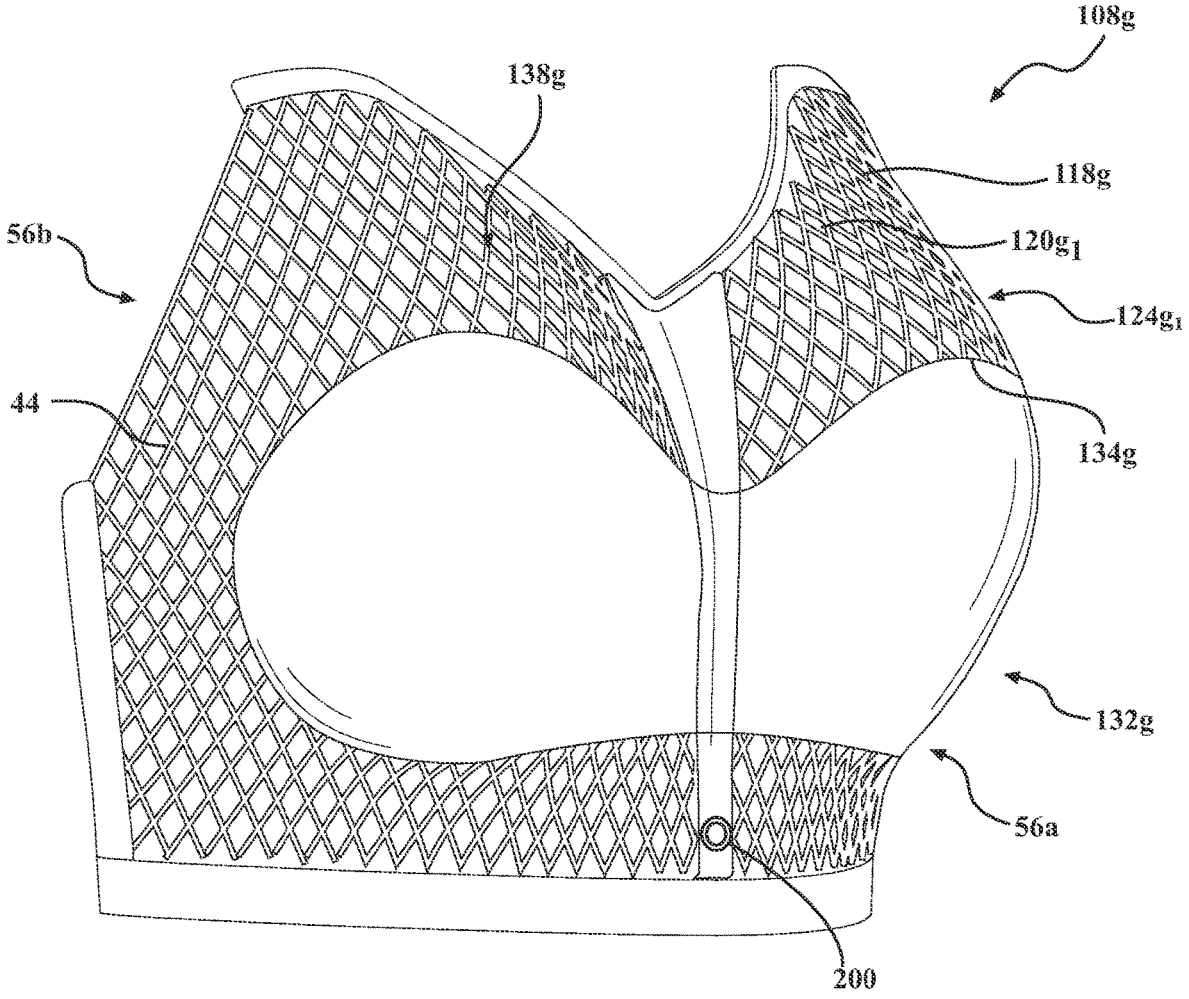
FIG. 13A is a perspective view of a compressible component according to the present disclosure, where an adjustment zone is disposed along a perimeter of the compressible component and around a static region.
Figure 13B:
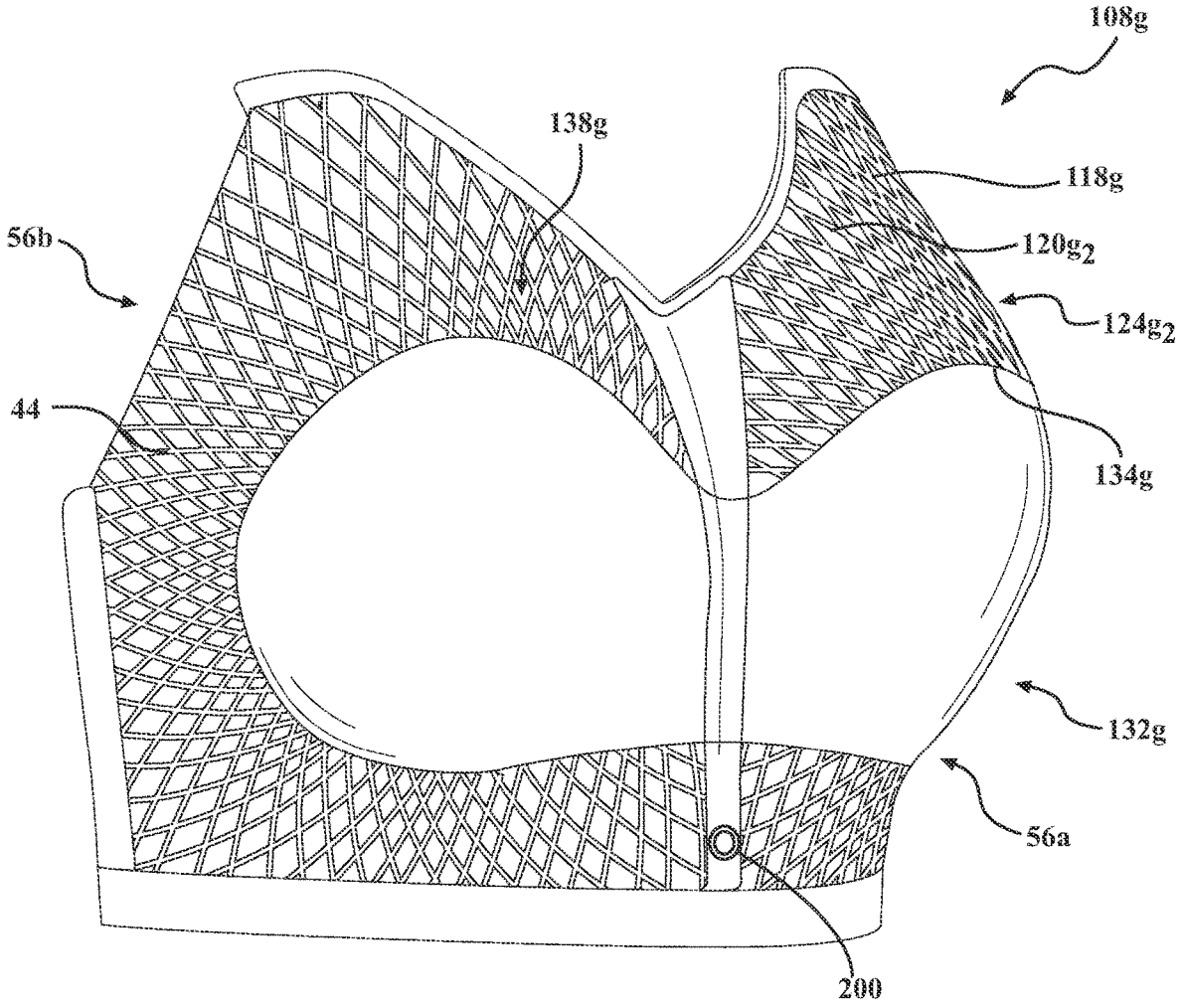
FIG. 13B is a perspective view of a compressible component according to the present disclosure, where an adjustment zone includes reliefs radially oriented around a static region.

With particular reference to FIGS. 13A and 13B, a compressible component 108*g* is provided. In view of the substantial similarity in structure and function of the components associated with the compressible component 108, like reference numerals are used hereinafter and in the drawings to identify like components while like reference numerals containing letter extensions are used to identify those components that have been modified.

The compressible component 108*g* illustrated in FIG. 13A has an adjustment zone 124$g_1$ disposed along a perimeter 138*g* of the compressible component 108*g* and including a lattice structure 118*g* with reliefs 120$g_1$. A static region 132*g* is generally surrounded by the adjustment zone 124$g_1$ and generally corresponds to the central cup region 52 of the bra 10 (FIG. 1). It is contemplated that the lattice structure 118*g* of the compressible component 108*g* is disposed within the adjustment zone 124$g_1$ to translate, in part, the adjustment zone 124$g_1$ between a relaxed state and a constricted state, while the static region 132*g* is generally free from the lattice structure 118*g*. Alternatively, the static region 132*g* may be formed as an extension of the lattice structure 118*g*, such that the static region 132*g* may include the lattice structure 118*g*. Where the static region 132*g* is free from the lattice structure 118*g*, it is contemplated that the static region 132*g* of the compressible component 108*g* may be formed from a breathable material. For example, the static region 132*g* may be formed from a breathable material having a form-fit with the wearer while remaining flexible. By way of example, not limitation, the static region 132*g* may be formed from spandex, lycra, and other practicable materials and combinations thereof. In either configuration, it is generally contemplated that the static region 132*g* is fluidly sealed from or otherwise impermeable relative to the adjustment zone 124$g_1$ via a barrier 134*g*, such that when a vacuum is drawn in the adjustment zone 124$g_1$ the static region 132*g* remains generally unaffected by the drawn vacuum and there is no fluid communication between the static region 132*g* and the adjustment zone 124$g_1$. Additionally or alternatively, the barrier 134*g* may be formed from an impermeable coating at a junction between the static region 132*g* and the adjustment zone 124$g_1$. The impermeable coating or barrier 134*g* is configured to prevent fluid communication between the static region 132*g* and the adjustment zone 124$g_1$. It is generally contemplated that the static region 132*g* is sealed or otherwise impermeable relative to the adjustment zone 124$g_1$ via the barrier 134*g*, such that when a vacuum is drawn in the adjustment zone 124*g* the static region 132*g* remains generally unaffected by the drawn vacuum. The barrier 134*g* is configured to prevent fluid communication between the static region 132*g* and the adjustment zone 124$g_1$.

An alternate configuration of the compressible component 108*g* is illustrated in FIG. 13B with an adjustment zone 124$g_2$ disposed along the perimeter 138*g* of the compressible component 108*g*. The adjustment zone 124$g_2$ includes reliefs 120$g_2$ of the lattice structure 118*g* radially oriented around the static region 132*g*. The radial extension of the reliefs 120$g_2$ may assist in form-fitting the compressible component 108*g* with the wearer. State differently, the reliefs 120$g_2$ of the lattice structure 118*g* may have a radial orientation relative to the static region 132*g* to extend in a radial direction about the static region 132*g*.

Figure 14:
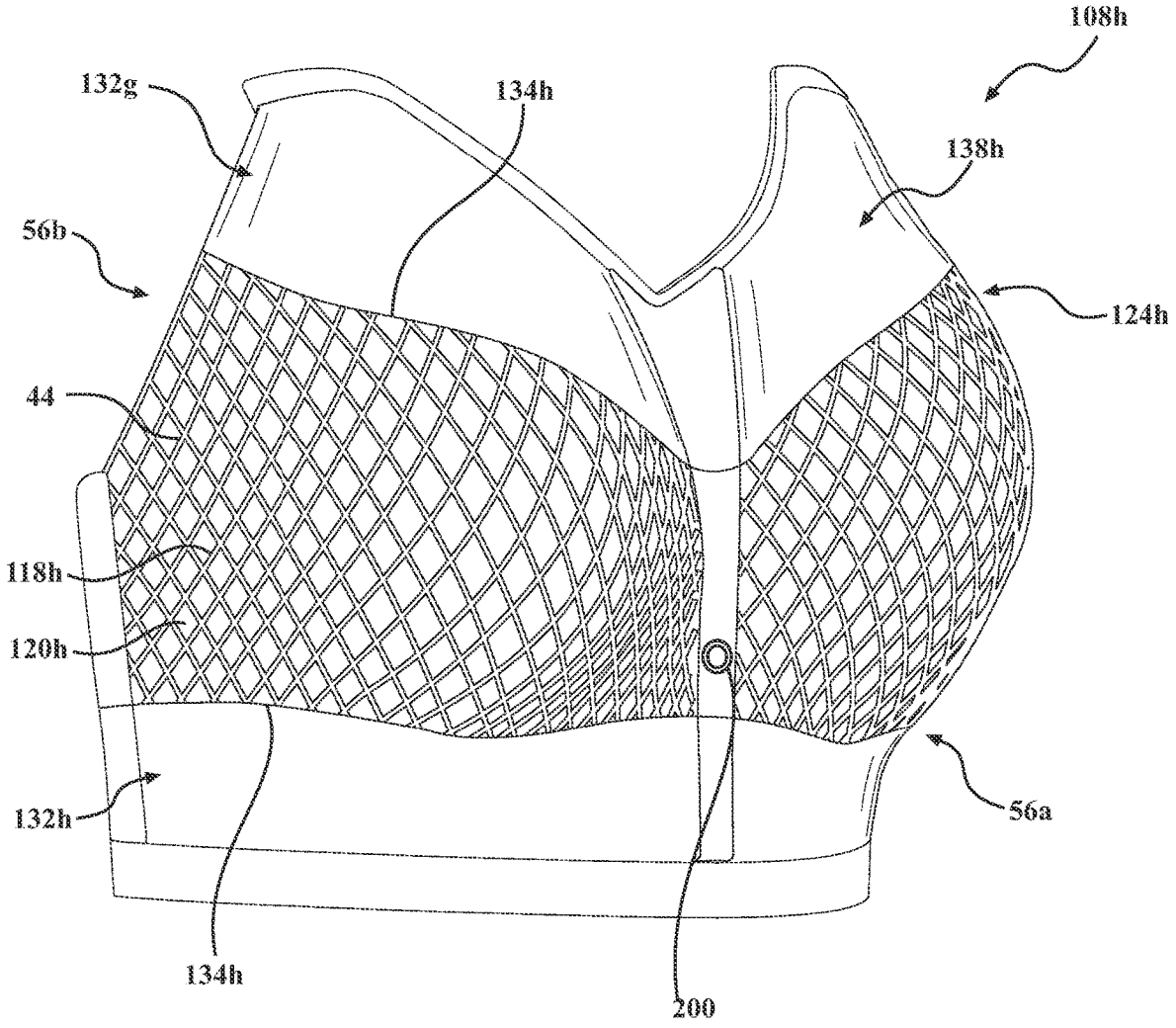
FIG. 14 is a perspective view of a compressible component according to the present disclosure, where a static region is disposed around an adjustment zone of the compressible component.
Figure 15A:
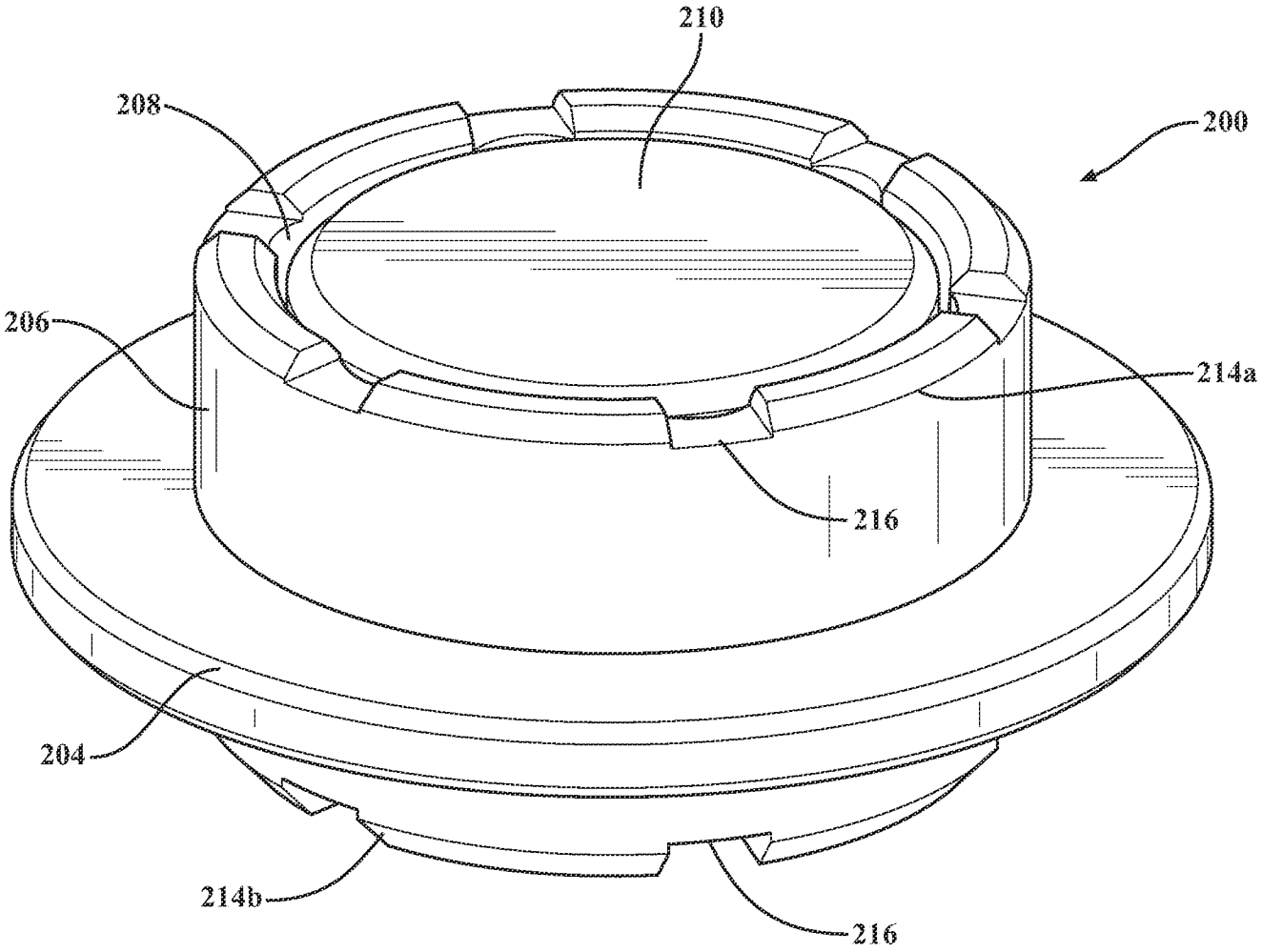
FIG. 15A is a perspective view of a port according to the present disclosure.
Figure 15B:
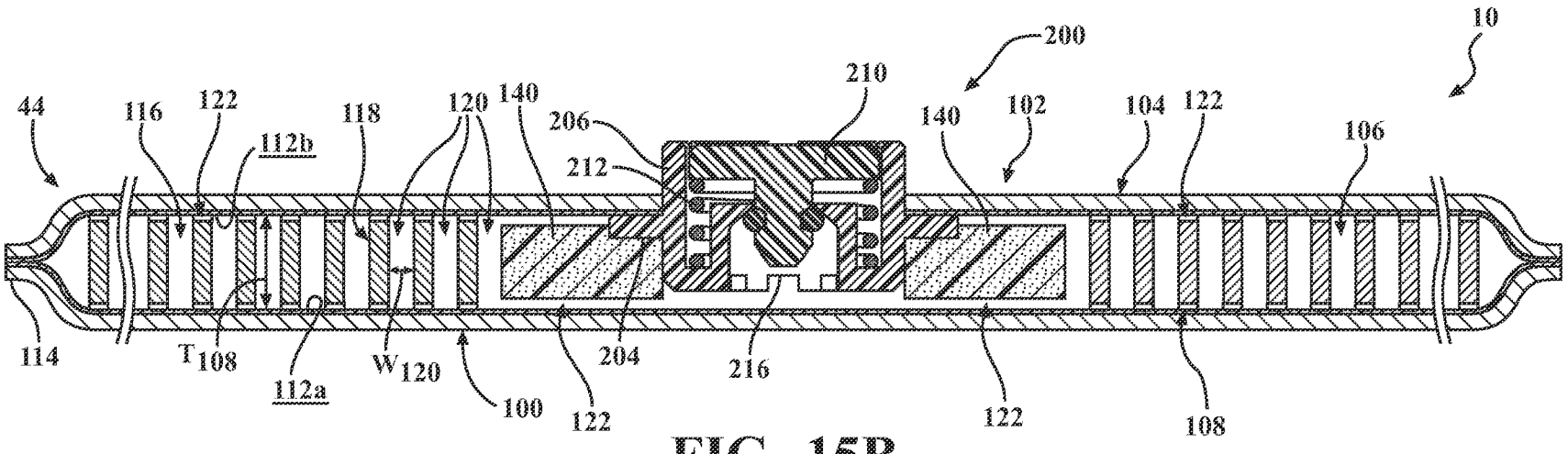
FIG. 15B is a cross-sectional view of the port of FIG. 15A integrated with an article of apparel, taken along Line 15B-15B in FIG. 17A, where the port includes an actuator in an extended position.
Figure 15C:
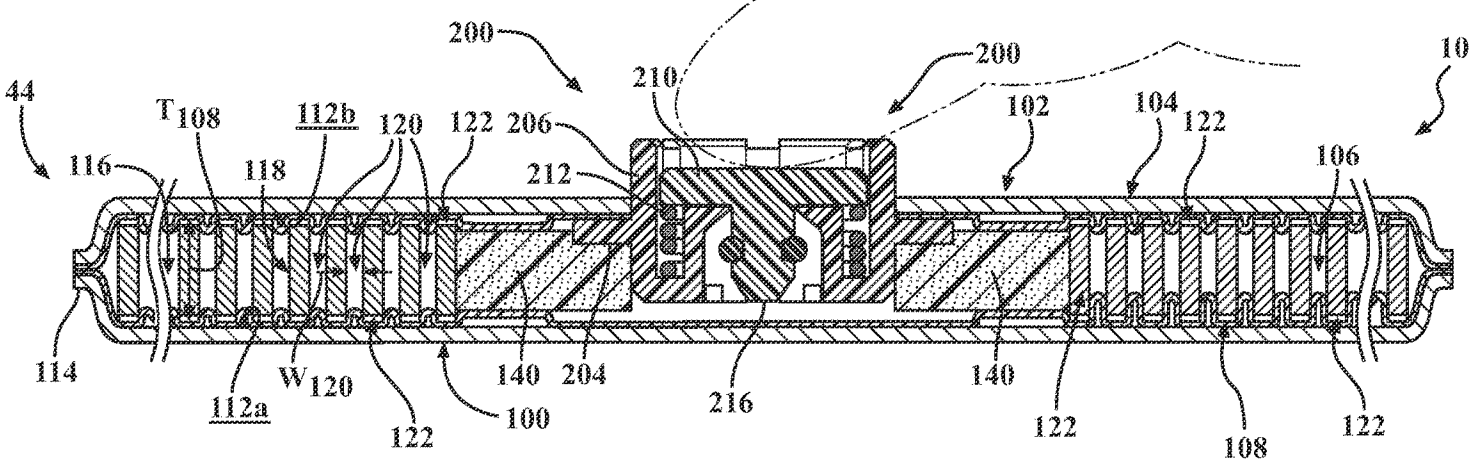
FIG. 15C is a cross-sectional view of the port of FIG. 15A integrated with an article of apparel, taken along Line 15C-15C in FIG. 17B, where the port includes an actuator in a compressed position.
Figure 16C:
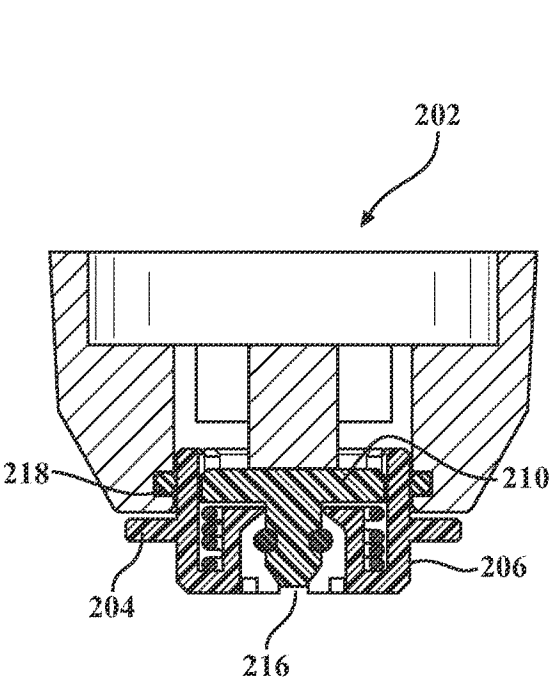
FIG. 16C is a cross-sectional view of the pump and the port of FIG. 16B, where the pump is engaged with the port.
Figure 16B:
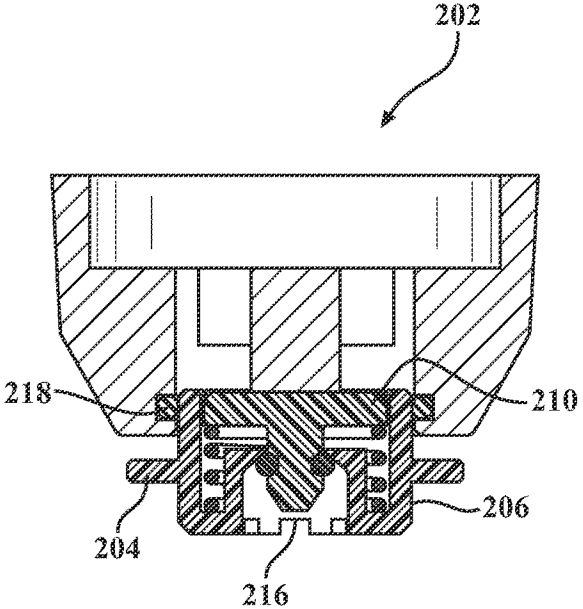
FIG. 16B is a cross-sectional view of the pump and the port of FIG. 16A, where the pump is disposed over and disengaged from the port.
Figure 16A:
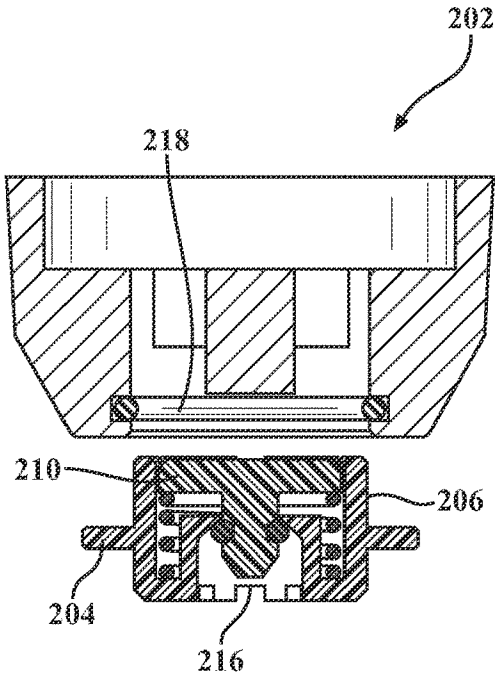
FIG. 16A is a cross-sectional view of a pump and a port according to the present disclosure, where the pump is disconnected from the port.

With particular reference to FIG. 14, a compressible component 108*h* is provided. In view of the substantial similarity in structure and function of the components associated with the compressible component 108, like reference numerals are used hereinafter and in the drawings to identify like components while like reference numerals containing letter extensions are used to identify those components that have been modified.

The compressible component 108*h* illustrated in FIG. 14 has a static region 132*h* disposed along a perimeter 138*h* of the compressible component 108*h* around an adjustment zone 124*h*. The adjustment zone 124*h* generally corresponds to the central cup region 52 of the bra 10 (FIG. 1). It is contemplated that a lattice structure 118*h* of the compressible component 108*h* is disposed within the adjustment zone 124*h* to translate, in part, the adjustment zone 124*h* between a relaxed state and a constricted state, while the static region 132*h* is generally free from the lattice structure 118*h*. Alternatively, the static region 132*h* may be formed as an extension of the lattice structure 118*h*, such that the static region 132*h* may include the lattice structure 118*h*. Where the static region 132*h* is free from the lattice structure 118*h*, it is contemplated that the static region 132*h* of the compressible component 108*h* may be formed from a breathable material. For example, the static region 132*h* may be formed from a breathable material having a form-fit with the wearer while remaining flexible. By way of example, not limitation, the static region 132*h* may be formed from spandex, lycra, and other practicable materials and combinations thereof. In either configuration, it is generally contemplated that the static region 132*h* is fluidly sealed from or otherwise impermeable relative to the adjustment zone 124*h* via a barrier 134*h*, such that when a vacuum is drawn in the adjustment zone 124*h* the static region 132*h* remains generally unaffected by the drawn vacuum and there is no fluid communication between the static region 132*h* and the adjustment zone 124*h*. Additionally or alternatively, the barrier 134*h* may be formed from an impermeable coating at a junction between the static region 132*h* and the adjustment zone 124*h*. The impermeable coating or barrier 134*h* is configured to prevent fluid communication between the static region 132*h* and the adjustment zone 124*h*. It is generally contemplated that the static region 132*h* is sealed or otherwise impermeable relative to the adjustment zone 124*h* via the barrier 134*h*, such that when a vacuum is drawn in the adjustment zone 124*h* the static region 132*h* remains generally unaffected by the drawn vacuum. The barrier 134*h* is configured to prevent fluid communication between the static region 132*h* and the adjustment zone 124*h*.

It is further contemplated that any one of the compressible components 108-108*h* described herein may be incorporated in any portion of the bra 10. For example, the compressible component 108-108*h* may be incorporated as part of the rear panel 62 in addition or alternative to the front panel 44. The addition of the compressible component 108-108*h* along the rear panel 62 may further assist in providing support for the wearer by drawing the vacuum to compress the reliefs 120-120*h* of the lattice structure 118-118*h*. It is also contemplated that the compressible components 108-108*h* may be incorporated in other portions of the bra 10 including, but not limited to, the straps 64 in combination with or independently of the front panel 44 and the rear panel 62. The adjustment provided by the placement of the compressible components 108-108*h* may advantageously assist in providing additional comfort for the wearer as a result of the customized compression formed by the vacuum compressing or otherwise constricting the lattice structure 118-118*h* of the respective compressible component 108-108*h*.

In any one of these contemplated configurations, the chamber 116, in which the respective compressible component 108-108*h* is disposed, is sealed from other regions of the bra 10. For example, the adjustment zones 124-124*h* may be sealed by welding or otherwise sealing off individual reliefs 120-120*h* that border the first and second adjustment zones 124-124*h*. The reliefs 120-120*h* proximate to the static region 132*a*-132*h* may also be sealed to minimize fluid flow proximate to and prevent fluid-flow within the static regions 132*a*-132*h*.

In one example, the compressible components 108-108*h* may be configured with additional static regions 132*a*-132*h*, such that additional portions of the compressible components 108-108*h* may be static or otherwise free from reliefs 120, as described above. Stated differently, the compressible components 108-108*h* may include, in addition to those described above, regions with the lattice structure 118 (e.g., the adjustment zone(s) 124-124*h*) and regions that are free from the lattice structure 118 (e.g., the static regions 132*a*-132*h*). By way of example, not limitation, each of the compressible components 108-108*h* described herein may be disposed within the bladder 104 and may be sealed or otherwise segmented into the adjustment zone(s) 124-124*h* to advantageously provide various compression configurations. It is also contemplated that the compressible components 108-108*h* with one or more of the adjustment zone(s) 124-124*h*, may be disposed in a bottom portion, a top portion, an annular portion of the cups 58, 60, and/or any combination thereof. Optionally, the bra 10 may include one or more bladders 104 that provide the adjustment zone(s) 124-124*h*. In such a configuration, the one or more bladders 104 are assembled to form the bra 10.

The compressible components 108-108*h* include one or more resilient materials configured to bias the adjustment element 102 towards the expanded or relaxed state. For example, the compressible components 108-108*h* may include an elastomeric material, such as the EVA foam. In one example, the EVA foam may have a thickness of approximately 6 millimeters. Alternatively, the thickness of the EVA foam may be greater than or less than approximately 2 millimeters to approximately 10 millimeters. In other examples, the compressible components 108-108*h* may include unfoamed polymers, such as thermoplastic polyurethane. Optionally, the compressible components 108-108*h* may include fiber-reinforced elastomeric materials. By way of example, not limitation, the compressible components 108-108*h* may include a TPU textile composite. In some implementations, the compressible components 108-108*h* may be formed from 3D printing. In addition to including different materials, the lattice structure 118 may include different geometrical configurations to impart different constriction profiles in different areas of the adjustment element 102. Optionally, a thickness of the compressible components 108-108*h* ranges from 4 millimeters to 8 millimeters to provide the adjustment element 102 with a relatively low profile while also providing sufficient structural strength for biasing the adjustment element 102 to the expanded or relaxed state.

Referring to FIGS. 15A-17B, an example of a port 200 and a pump 202 utilized for adjusting a pressure of the bladder 104 of the bra 10 is provided. The port 200 may be coupled to the bladder 104 and operable to selectively permit fluid communication with the bladder space or interior void 106. The port 200 includes a flange 204 extending from a body 206 that includes an aperture 208. The flange 204 may be utilized to couple the port 200 to the center bridge 48 (FIG. 1) and the central element 126. For example, the port 200 may be welded to the center bridge 48 at the flange 204. An actuator 210 is disposed within the aperture 208 and is coupled to a biasing member 212 (FIG. 15B). The biasing member 212 is configured to bias the actuator 210 from an open position in which fluid may enter or exit the port 200 to a closed position in which the port 200 is sealed. As shown, the body 206 includes an outer or upper rim 214*a* extending from a first side of the flange 204 and an inner or lower rim 214*b* extending from an opposite second side of the flange 204. Fluid channels 216 are disposed along the rims 214*a*, 214*b* of the body 206 to promote fluid communication and/or movement and minimize potential obstruction during engagement of the actuator 210. For example, the wearer may compress the actuator 210 to release the fluid from the chamber 116, illustrated in FIG. 15C, and the fluid channels 216 assist in the movement of the fluid from the port 200. As mentioned above, the first zone of the bladder 104 is configured for selective fluid communication between the interior space of the first zone and the atmosphere and/or the pump 202 via the port 200. Additionally or alternatively, the second zone of the bladder 104 may be sealed from the first zone and the port 200.

While described herein in relation to the bra 10, it is appreciated that the port 200 may be utilized in various articles including, but not limited to, shoes, backpacks, bags, shirts, and/or other articles of apparel. Further, the port 200 could be used in conjunction with other similar articles such as the bra 10*a* (FIG. 2) described above. It is also contemplated that the port 200 may be utilized in inflating and/or deflating the bladder 104, the bra 10, and/or any other article incorporated with the port 200. As discussed previously, the bra 10 is moved between the relaxed state and the constricted state by adjusting a fluid pressure within the interior void 106. For example, the pressure within the interior void 106 may be reduced by drawing a vacuum within the interior void 106 through the port 200 attached to the bladder 104. It is contemplated that the port 200 and the compressible component 108 may be at least partially separated by a pliable member 140. The pliable member 140 may be formed from an EVA material, and the channels 122 disposed along the compressible component 108 may extend through the pliable members 140 to define the fluid path between the port 200 and each of the reliefs 120 of the compressible component 108. The vacuum may be drawn using a pressure source, such as a pump 202 integrated within the bra 10 or provided as a peripheral (i.e., independent) accessory to the bra 10. However, the pump 202 may be attached or disposed in any portion of the bras 10, 10*a*, such as on the front panel 44, the straps 64, or in other regions of the bras 10, 10*a*. Further, the pump 202 may be a peripheral accessory not attached to the bra 10, such as an accessory pump exterior to and free from attachment with the bra 10. It is contemplated that the pump 202 may include, but is not limited to, an accessory pump that may be applied to the port 200, a clam-shell pump having an internal envelope that assists in drawing the vacuum, and/or a pump incorporated in one of the panels 44, 62 of the bra 10. The term pump 202 refers to drawing the vacuum within the chamber 116 of the adjustment element 102, such that the pump 202 pumps or otherwise draws the vacuum via automatic or manual components. By way of example, not limitation, where the pump 202 is an accessory pump, the pump 202 may include a cartridge configured with a preset vacuum to automatically draw the vacuum when the pump 202 is applied to the port 200.

Referring to FIGS. 15A-16C, during evacuation of the chamber 116, a tip or nozzle of the pump 202 is configured to receive the body 206 of the port 200 and is disposed around and generally seals the fluid channels 216. For example, the pump 202 includes a seal 218 that is coupled with the body 206 when the pump 202 is disposed over the port 200. In this configuration, fluid is drawn from the port 200 and minimizes backflow by sealing or otherwise obstructing the fluid channels 216 external to the chamber 116, as illustrated in FIG. 15C.

Figure 17A:
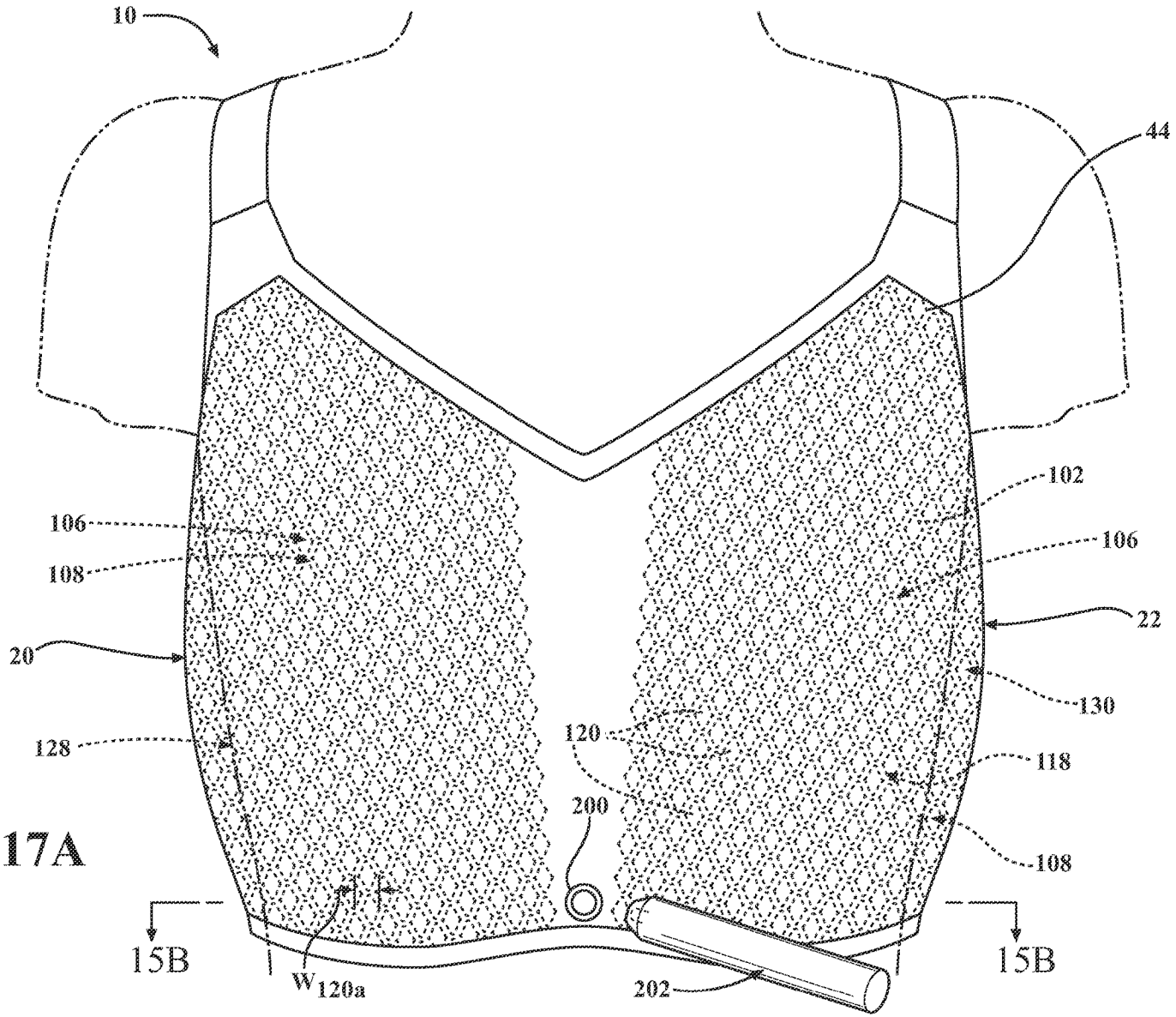
FIG. 17A is a front perspective view of an article of apparel incorporating a compressible component according to an example of the present disclosure, where the article of apparel is in a relaxed state.
Figure 17B:
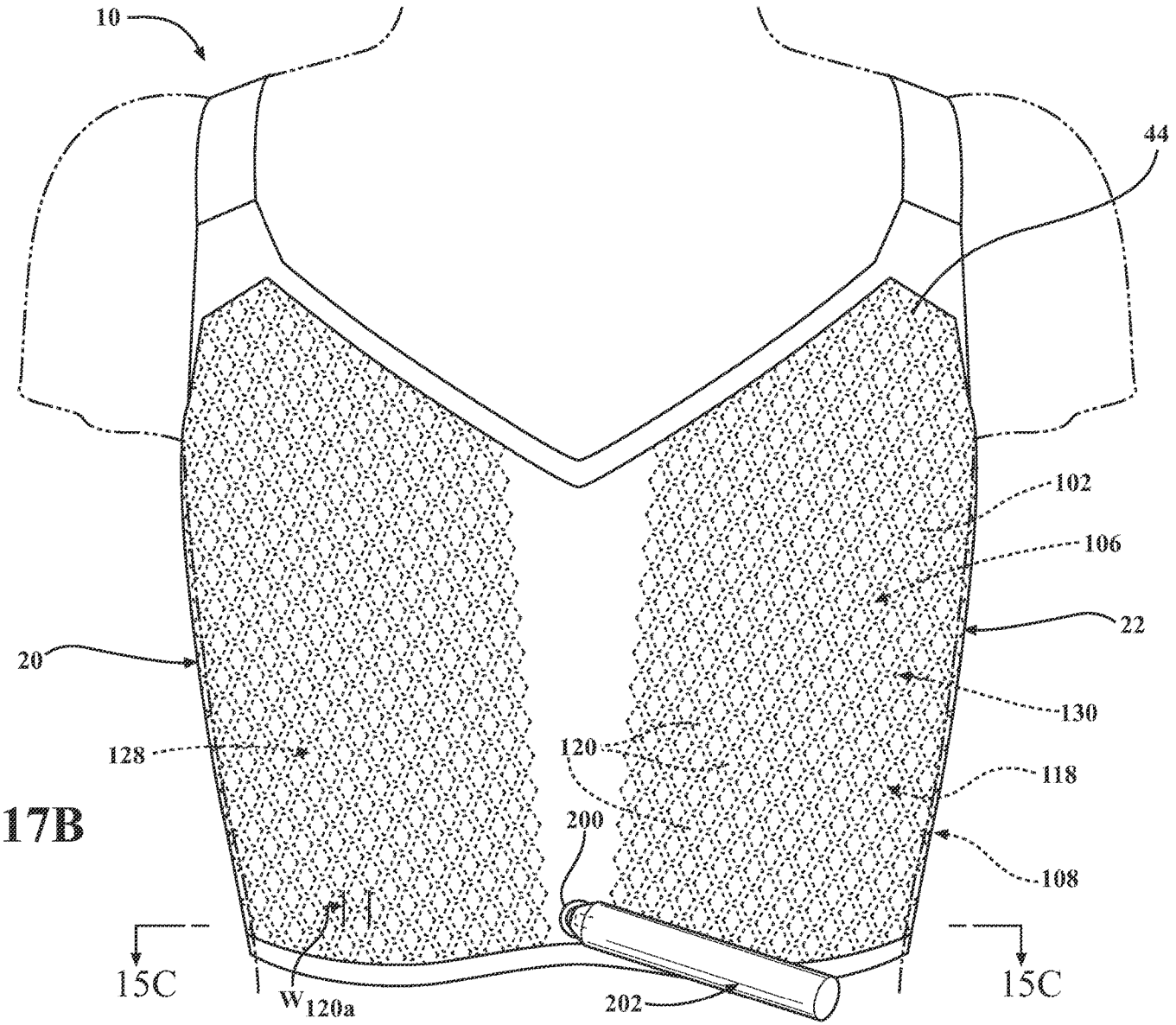
FIG. 17B is a front perspective view of the article of apparel of FIG. 17A, where the article of apparel is in a constricted state.

Referring to FIGS. 17A and 17B, an example of using the port 200 and the pump 202 to adjust the bra 10 is provided. As the pressure is reduced (e.g., below ambient) within the interior void 106, the lattice structure 118 collapses along the width-wise directions of the reliefs while the front panel 44 constricts around the upper-torso (FIG. 17B). Conversely, to move the bra 10 to the relaxed state, the pressure within the interior void 106 is increased and the resilient material and/or geometry of the lattice structure 118 biases the bra 10 towards the expanded state (FIG. 17A). It is contemplated that one or more intermediate states may be achieved when the compressible component 108 transitions between the relaxed state and the contracted state and vice versa. In one example, the wearer may selectively contract and/or relax the compressible component 108, such that the compressible component 108 may statically remain in one of the one or more intermediate state. In an alternate aspect, the right and left sides 128, 130 of the compressible components 108 may be independently and selectively adjustable. For example, the right side 20 of the bra 10 may be sealed relative to the left side 22 of the bra 10, and the wearer may selectively evacuate the adjustment element 102 to compress one of the right and/or left sides 128, 130 of the compressible component 108. In this configuration, it is contemplated that the bra 10 may include multiple ports 200 to selectively compress the right and/or left sides 128, 130 of the compressible component 108 independently, such that one side of the compressible component 108 may compress to a greater or lesser extent compared to the adjacent and/or opposing side of the compressible component 108.

Figure 18A:
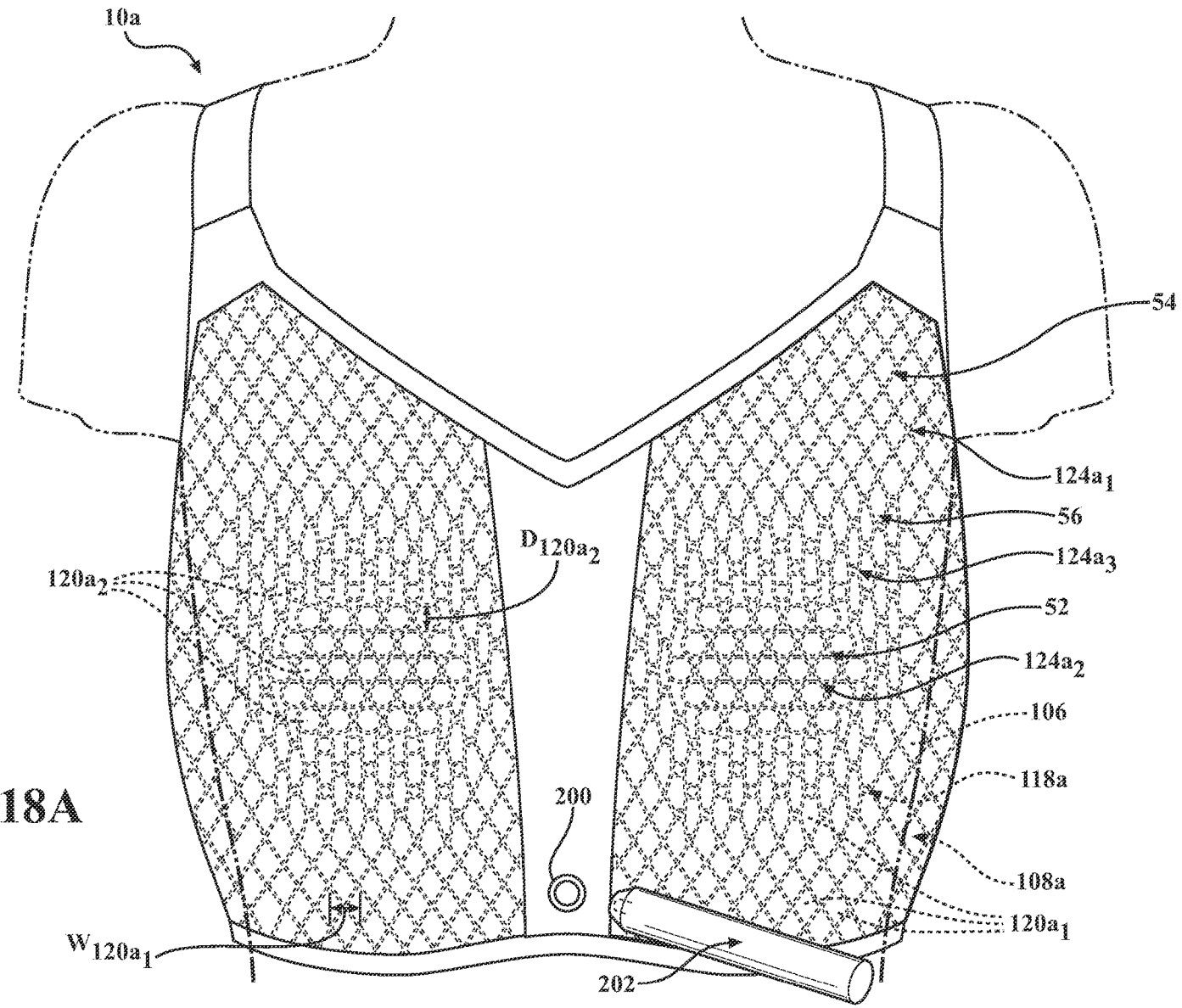
FIG. 18A is a front perspective view of an article of apparel incorporating a compressible component according to an example of the present disclosure, where the article of apparel is in a relaxed state.
Figure 18B:
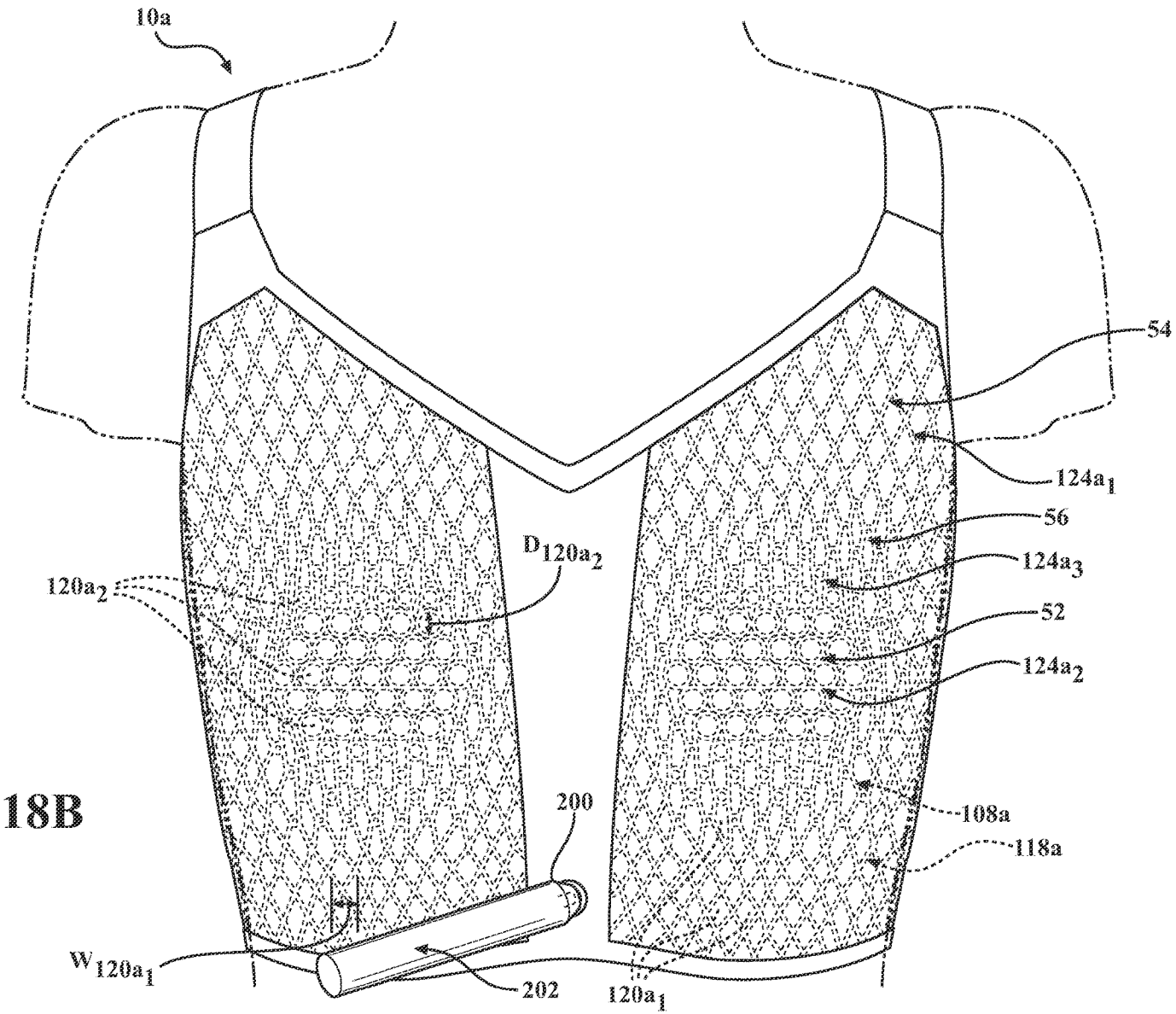
FIG. 18B is a front perspective view of the article of apparel of FIG. 18A, where the article of apparel is in a constricted state.

Referring to FIGS. 18A and 18B and as mentioned above, the pump 202 is utilized to draw a vacuum via the port 200 to compress or otherwise constrict the reliefs $\mathbf{120}a_1$, such that the width $W_{120a1}$ reduces under the vacuum. The reduced width $W_{120a1}$ results in a constriction of the bra 10*a* about the wearer in the first and third adjustment zones $\mathbf{124}a_1$, $\mathbf{124}a_3$. The constriction of the bra 10*a* at the first and third adjustment zones $\mathbf{124}a_1$, $\mathbf{124}a_3$ advantageously provides support for the wearer and constriction in the perimeter cup and transition regions 54, 56, respectively. It is contemplated that the portions of the upper-torso of the wearer that are generally proximate to and covered by the perimeter cup and transition regions 54, 56 are less sensitive, such that greater compression may be utilized as compared to the central cup region 52. Additionally or alternatively, each of the central cup, perimeter cup, and transition regions 52, 54, 56 may have a degree of constriction under the vacuum pressure, such that the upper-torso of the wearer is generally secured to minimize potential vertical movement of the upper-torso. As mentioned above, portions of the second adjustment zone $\mathbf{124}a_2$ may compress to a lesser degree compared to the first and third adjustment zones $\mathbf{124}a_1$, $\mathbf{124}a_3$ to provide additional support for the wearer while minimizing the overall compressive force in the central cup region 52 of the bra 10*a*. While it is contemplated that some degree of compression may occur in the second adjustment zone $\mathbf{124}a_2$, it is also contemplated that the second adjustment zone $\mathbf{124}a_2$ may remain static, such that the reliefs $\mathbf{120}a_2$ remain stationary during the transition of the adjustment element 102*a* from the relaxed state (FIG. 18A) to the constricted state (FIG. 18B).

Referring again to FIGS. 1-19, the bra 10 may provide compressive support by utilizing the adjustment element 102. As compared to a standard bra, the adjustment element 102 of the bra 10, as described herein, utilizes the compression formed by drawing the vacuum to form a custom fit for the wearer. The arrangement of the reliefs 120 of the compressible component 108 may advantageously include the adjustment zone(s) 124 to provide customized support and/or compression for the wearer. For example, the reliefs 120 may be arranged in a radial configuration and/or an array configuration. The bra 10 also includes the port 200 to advantageously provide selective evacuation and release of the adjustment element 102. The wearer may utilize the pump 202 to draw the at least partial vacuum within the interior void 106 of the adjustment element 102 to compress or otherwise contract the compressible component 108.

Figure 19:
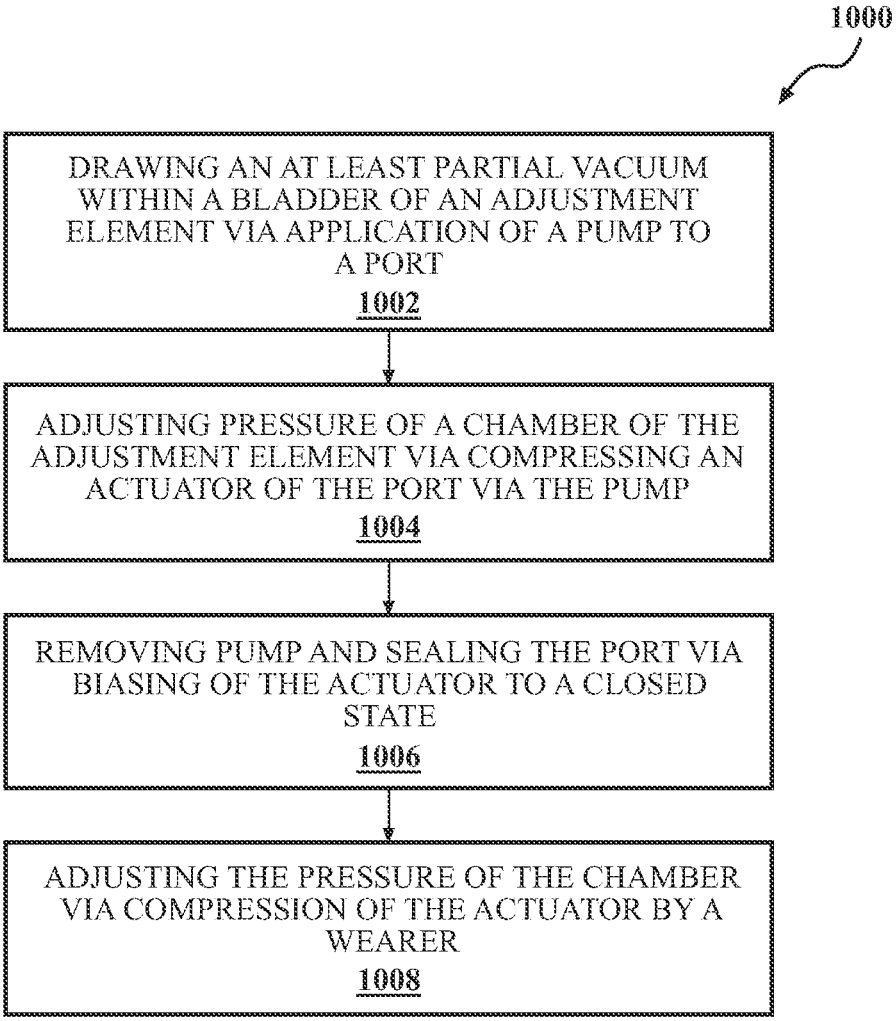
FIG. 19 is a flow chart of a method of adjusting an article of apparel in accordance with the principles of the present disclosure.

For example, and with reference to FIG. 19, a method (1000) of operating the bra 10 is provided. The wearer may apply the pump 202 to the port 200 to draw an at least partial vacuum within the bladder 104 of the adjustment element 102 (step 1002). The pump 202 compresses the actuator 210 of the port 200 to allow the pump 202 to be in fluid communication with the interior void 106 of the bladder 104. Once in fluid communication with the interior void 106, the pump 202 is able to remove fluid from the bladder 104 and adjust the pressure of the interior void 106 of the chamber 116. When the pressure within the interior void 106 is sufficiently reduced by removing a predetermined volume of fluid, compression of the compressible component 108 (step 1004) is achieved. The wearer removes the pump 202 once a desired compression is achieved, and the actuator 210 is biased to a closed state to seal the port 200 (step 1006). Optionally, the wearer may adjust the pressure within the chamber 116 by depressing the actuator 210 to allow fluid to enter the interior void 106 and release the compression defining the intermediate state of the compressible component 108 (step 1008). The wearer may repeatedly adjust the compressible component 108 using the pump 202 and may depress the actuator 210 to achieve a custom state of the compressible component 108 and custom fit of the bra 10.

A method of manufacturing includes laser etching and subsequently thermoforming the compressible component 108 to define the lattice structure 118. The compressible component 108 may then be positioned between the first and second barrier layers 112*a*, 112*b* and the bladder 104 may be defined to form the adjustment element 102. The barrier layers 112*a*, 112*b* may be sealed along the peripheral seam 114 to form the interior void 106 in which the compressible component 108 may be disposed.

In one example, method of manufacturing an article of apparel comprises forming an outer barrier layer and an inner barrier layer of a bladder; forming a compressible component, the compressible component including a first zone, the first zone operable between a contracted state and a relaxed state; coupling the outer barrier layer, the compressible component, and the inner barrier layer at a peripheral edge of the bladder; and fluidly coupling a port to the bladder, the port operable to selectively permit fluid communication between the compressible component and the bladder. Further, forming the inner barrier layer, the outer barrier layer, and the compressible component includes forming each of the inner barrier layer, the outer barrier layer and the compressible component into a three-dimensional shape. In one example, forming the compressible component includes laser cutting the compressible component to form a plurality of reliefs in the first zone and then, thermoforming the compressible component into the three-dimensional shape.

The following Clauses provide an exemplary configuration for an article of apparel described above.

Clause 1. An article of apparel includes a bladder including an interior void, a compressible component disposed within the interior void and including a first cup extending to a first apex and a second cup extending to a second apex, the compressible component including a first zone operable between a contracted state and a relaxed state, and a port fluidly coupled to the bladder and operable to move the first zone between the contracted state and the relaxed state by selectively permitting fluid communication with the interior void.

Clause 2. The article of apparel of Clause 1, wherein the first zone is spaced apart from the first cup.

Clause 3. The article of apparel of either of Clause 1 or Clause 2, wherein the first zone extends over at least a portion of the first cup.

Clause 4. The article of apparel of any of the preceding Clauses, wherein the first zone includes a first plurality of reliefs having a first shape.

Clause 5. The article of apparel of Clause 4, wherein the compressible component includes a second zone disposed adjacent to the first zone and including a second plurality of reliefs.

Clause 6. The article of apparel of Clause 5, wherein reliefs of the second plurality of reliefs include the same shape as reliefs of the first plurality of reliefs.

Clause 7. The article of apparel of either of Clause 5 or Clause 6, wherein the reliefs of the second plurality of reliefs are oriented in a transverse direction relative to the reliefs of the first plurality of reliefs.

Clause 8. The article of apparel of any of the preceding Clauses, further comprising a lining operable to surround a torso of a wearer and a second cup spaced apart from the first cup, the first cup and the second cup extending to a respective apex in a direction away from the lining.

Clause 9. The article of apparel of Clause 8, wherein the compressible component extends at least partially over the first cup and the second cup.

Clause 10. The article of apparel of either of Clause 8 or Clause 9, wherein the port is disposed between the first cup and the second cup.

Clause 11. The article of apparel of any of the preceding Clauses, wherein the compressible component includes a static region and the first zone of the compressible component includes a plurality of reliefs oriented in a radial direction relative to the static region.

Clause 12. An article of apparel includes a bladder including an interior void, a compressible component disposed within the interior void and including a first cup extending to a first apex and a second cup extending to a second apex, the compressible component including a first zone operable between a contracted state and a relaxed state, and a port fluidly coupled to the bladder and operable to move the first zone between the contracted state and the relaxed state by selectively permitting fluid communication with the interior void.

Clause 13. The article of apparel of Clause 12, wherein the first zone extends over the first apex.

Clause 14. The article of apparel of Clause 13, wherein the first zone extends over the second apex.

Clause 15. The article of apparel of any of the preceding Clauses, wherein the first zone includes a first plurality of reliefs having a first shape.

Clause 16. The article of apparel of Clause 15, wherein the compressible component includes a second zone disposed adjacent to the first zone and including a second plurality of reliefs.

Clause 17. The article of apparel of Clause 16, wherein reliefs of the second plurality of reliefs include the same shape as the reliefs of the first plurality of reliefs.

Clause 18. The article of apparel of any of the preceding Clauses, wherein the first zone extends at least partially over the first apex and the second apex.

Clause 19. The article of apparel of any of the preceding Clauses, wherein the port is disposed between the first cup and the second cup.

Clause 20. The article of apparel of any of the preceding Clauses, wherein a height of the first apex and the second apex is reduced when the first zone is in the contracted state.

Clause 21. A bra incorporating the article of apparel of any of the preceding Clauses.

Clause 22. The article of apparel of any of the preceding Clauses, wherein the compressible component includes a static region and the first zone of the compressible component includes a plurality of reliefs oriented in a radial direction relative to the static region.

Clause 23. A method of manufacturing an article of apparel, the method including forming a bladder having an interior void, positioning a compressible component within the interior void, the compressible component including a first cup and a first zone, the first zone operable between a contracted state and a relaxed state, and fluidly coupling a port to the bladder, the port operable to selectively permit fluid communication with the interior void.

Clause 24. The method of Clause 23, further comprising spacing the first zone apart from the first cup.

Clause 25. The method of either of Clause 23 or Clause 24, further comprising extending the first zone over at least a portion of the first cup.

Clause 26. The method of any of the preceding Clauses, further comprising providing the first zone with a first plurality of reliefs having a first shape.

Clause 27. The method of Clause 26, further comprising providing the compressible component with a second zone disposed adjacent to the first zone and including a second plurality of reliefs.

Clause 28. The method of Clause 27, further comprising providing reliefs of the second plurality of reliefs with the same shape as reliefs of the first plurality of reliefs.

Clause 29. The method of either of Clause 27 or Clause 28, further comprising orienting reliefs of the second plurality of reliefs in a transverse direction relative to the reliefs of the first plurality of reliefs.

Clause 30. The method of any of the preceding Clauses, further comprising providing a lining operable to surround a torso of a wearer and a second cup spaced apart from the first cup, the first cup and the second cup extending to a respective apex in a direction away from the lining.

Clause 31. The method of Clause 30, further comprising extending the compressible component at least partially over the first cup and the second cup.

Clause 32. The method of either Clause 30 or Clause 31, further comprising positioning the port between the first cup and the second cup.

Clause 33. An article of apparel comprising a first barrier layer, a second barrier layer, and a compressible component disposed between the first and second barrier layers and including a plurality of reliefs, the compressible component operable between a contracted state and a relaxed state and at least one of the first and second barrier layers at least partially depressed within the plurality of reliefs in the contracted state.

Clause 34. The article of apparel of Clause 33, wherein the plurality of reliefs elongate along a y-axis in the contracted state of the compressible component.

Clause 35. The article of apparel of either of Clause 31 or Clause 32, wherein the plurality of reliefs shrink along an x-axis in the contracted state of the compressible component.

Clause 36. The article of apparel of any one of the preceding Clauses, wherein the plurality of reliefs are compressed along a z-axis in the contracted state of the compressible component.

Clause 37. The article of apparel of any one of the preceding Clauses, wherein the first barrier layer is disposed within the plurality of reliefs in the contracted state of the compressible component.

Clause 38. An article of apparel comprising a bladder including an outer barrier layer, an inner barrier layer, and a bladder space therebetween, a compressible component disposed within the bladder space, the compressible component including a plurality of reliefs, and wherein the bladder is configured to form a three-dimensional shape.

Clause 39. The article of apparel of Clause 38, further comprising a port fluidly coupled to the bladder and operable to selectively permit fluid communication with the bladder space.

Clause 40. The article of apparel of either of Clause 38 or 39, wherein the three-dimensional shape is based on a body part shape.

Clause 41. The article of apparel of any of the preceding Clauses, wherein the three-dimensional shape is a bra cup shape.

Clause 42. The article of apparel of any of the preceding Clauses, wherein each of the plurality of relief have a first geometric shape.

Clause 43. The article of apparel of any of the preceding Clauses, wherein the plurality of reliefs are configured to form a lattice structure.

Clause 44. The article of apparel of any of the preceding Clauses, wherein the outer barrier layer, the inner barrier layer, and the compressible component are coupled along a perimeter of the bladder.

Clause 45. The article of apparel of any of the preceding Clauses, wherein the bladder is operable to transition between a fully relaxed state, a fully contracted state, and one or more intermediate states.

Clause 46. The article of apparel of any of the preceding Clauses, wherein the compressible component comprises a first surface facing the outer barrier layer and a second opposite surface facing the inner barrier layer, and wherein the first surface and the outer barrier layer are separate from each other except at the perimeter, and wherein the second surface and the inner barrier layer are separate from each other except at the perimeter.

Clause 47. The article of apparel of any of the preceding Clauses, wherein the bladder comprises a first zone and a second zone, and wherein the first zone is operable to transition between a fully relaxed state, a fully expanded state, and one or more intermediate states while the second zone remains in a substantially same state.

Clause 48. The article of apparel of any of the preceding Clauses, wherein the first zone is configured for selective fluid communication between an interior space of the first zone and the atmosphere and/or a pump via a port, and wherein, at the first zone, the first surface and the outer layer are separate from each other except at the first zone perimeter, and wherein the second surface and the inner layer are separate from each other except at the first zone perimeter.

Clause 49. The article of apparel of any of the preceding Clauses, wherein, at the second zone, the second surface is fused with the outer layer at one or more regions and the first surface is fused with the inner layer at the one or more regions.

Clause 50. The article of apparel of any of the preceding Clauses, wherein, at the second zone, the second surface is fully fused with the outer layer and the first surface is fully fused with the inner layer.

Clause 51. The article of apparel of any of the preceding Clauses, wherein the bladder comprises a plurality of zones, each zone configured to provide a degree of containment to a wearer.

Clause 52. The article of apparel of any of the preceding Clauses, wherein the degree of containment is different across different zones.

Clause 53. A support garment comprising a bladder comprising an outer barrier layer, an inner barrier layer, and a bladder space therebetween, a compressible component disposed within the bladder space, the bladder space including a plurality of reliefs, wherein the bladder is configured to form a first three-dimensional shape, and wherein the bladder is configured to form a second three-dimensional shape responsive to a change in an amount of vacuum in the bladder space (or change in pressure).

Clause 54. A support garment comprising a first breast covering portion and a second breast covering portion, each of the first and the second breast covering portions including one or more zones, wherein at least one zone of the one or more zones comprises a bladder, the bladder comprising an outer barrier layer, an inner barrier layer, and an interior space therebetween, a compressible component disposed within the interior space, the compressible component including a plurality of cells forming a lattice structure, wherein the bladder is configured to have a first three-dimensional shape, and wherein the bladder is configured to transition from the first three-dimensional shape to a second three-dimensional shape or vice-versa, responsive to a change in an amount of vacuum in the interior space (or changes in pressure).

Clause 55. The support garment of Clause 54, wherein at a first amount of vacuum, the bladder is in the first three-dimensional shape and an outer surface of the bladder is substantially smooth when the bladder is in the first three-dimensional shape, and at a second amount of vacuum, the second amount greater than the first amount, the outer surface of the bladder has a plurality of ridges and/or depressions based on the lattice structure when the bladder is in the second three-dimensional shape.

Clause 56. The support garment of either Clause 54 or 55, wherein the plurality of reliefs are arranged along horizontal or vertical axes of the support garment.

Clause 57. The support garment of any of the preceding Clauses, wherein the plurality of reliefs are arranged radially in a direction from a center of the first and/or second breast covering portion towards a periphery of the first and/or second breast covering portion.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An article of apparel comprising:

a back panel; and a front panel attached to the back panel, the front panel including:

a bladder including an interior void, the bladder extending across a majority of the front panel;

a compressible component disposed within the interior void and including a first zone, the first zone operable between a contracted state and a relaxed state; and a port fluidly coupled to the bladder and operable to selectively permit fluid communication with the interior void.

2. The article of apparel of claim 1, wherein the compressible component includes a first apparel cup and the first zone is spaced apart from the first apparel cup.

3. The article of apparel of claim 1, wherein the compressible component includes a first apparel cup and the first zone extends over at least a portion of the first apparel cup.

4. The article of apparel of claim 1, wherein the first zone includes a first plurality of reliefs having a first shape.

5. The article of apparel of claim 4, wherein the compressible component includes a second zone disposed adjacent to the first zone and including a second plurality of reliefs.

6. The article of apparel of claim 5, wherein reliefs of the second plurality of reliefs include the same shape as reliefs of the first plurality of reliefs.

7. The article of apparel of claim 5, wherein the reliefs of the second plurality of reliefs are oriented in a transverse direction relative to the reliefs of the first plurality of reliefs.

8. The article of apparel of claim 2, wherein the front panel and the back panel cooperate to form a lining operable to surround a torso of a wearer and a second apparel cup spaced apart from the first apparel cup, the first apparel cup and the second apparel cup extending to a respective apex in a direction away from the lining.

9. The article of apparel of claim 8, wherein the compressible component extends at least partially over the first apparel cup and the second apparel cup.

10. The article of apparel of claim 8, wherein the port is disposed between the first apparel cup and the second apparel cup, the first apparel cup and the second apparel cup being in fluid communication.

11. The article of apparel of claim 1, wherein the compressible component includes a static region and the first zone of the compressible component includes a plurality of reliefs oriented in a radial direction relative to the static region.

12. An article of apparel comprising:

a back panel; and a front panel attached to the back panel, the front panel including:

a bladder including an interior void;

a compressible component disposed within the interior void and including a first apparel cup extending to a first apex and a second apparel cup extending to a second apex, the compressible component including a first zone operable between a contracted state and a relaxed state; and a port fluidly coupled to the bladder and operable to move the first zone between the contracted state and the relaxed state by selectively permitting fluid communication with the interior void.

13. The article of apparel of claim 12, wherein the first zone at least partially extends over the first apex and/or the second apex.

14. The article of apparel of claim 12, wherein the first zone includes a first plurality of reliefs having a first shape.

15. The article of apparel of claim 14, wherein the compressible component includes a second zone disposed adjacent to the first zone and including a second plurality of reliefs.

16. The article of apparel of claim 15, wherein reliefs of the second plurality of reliefs include the same shape as the reliefs of the first plurality of reliefs.

17. The article of apparel of claim 12, wherein the port is disposed between the first apparel cup and the second apparel cup.

18. The article of apparel of claim 12, wherein a height of the first apex and the second apex is reduced when the first zone is in the contracted state relative to a height of the first apex and the second apex when the first zone is in the relaxed state.

19. A bra incorporating the article of apparel of claim 12.

20. The article of apparel of claim 12, wherein the compressible component includes a static region and the first zone of the compressible component includes a plurality of reliefs oriented in a radial direction relative to the static region.

21. A method of manufacturing an article of apparel, the method comprising:

forming an outer barrier layer and an inner barrier layer of a bladder;

forming a compressible component, the compressible component including a first zone and a first apparel cup, the first zone operable between a contracted state and a relaxed state;

coupling the outer barrier layer, the compressible component, and the inner barrier layer at a peripheral edge of the bladder;

coupling the bladder to a front panel;

coupling the front panel to a back panel; and fluidly coupling a port to the bladder, the port operable to selectively permit fluid communication between the compressible component and the bladder.

22. The method of claim 21, further comprising spacing the first zone apart from the first apparel cup of the compressible component.

23. The method of claim 22, further comprising extending the first zone over at least a portion of the first apparel cup.

24. The method of claim 21, further comprising providing the first zone with a first plurality of reliefs having a first shape.

25. The method of claim 24, further comprising providing the compressible component with a second zone disposed adjacent to the first zone and including a second plurality of reliefs.

26. The method of claim 25, further comprising providing reliefs of the second plurality of reliefs with the same shape as reliefs of the first plurality of reliefs.

27. The method of claim 21, wherein forming the inner barrier layer, the outer barrier layer, and the compressible component includes forming each of the inner barrier layer, the outer barrier layer, and the compressible component into a three-dimensional shape.

28. The method of claim 22, wherein coupling the front panel to the back panel forms a lining operable to surround a torso of a wearer and a second apparel cup spaced apart from the first apparel cup, the first apparel cup and the second apparel cup extending to a respective apex in a direction away from the lining.

29. The method of claim 28, further comprising extending the compressible component at least partially over the first apparel cup and the second apparel cup.

30. The method of claim 28, further comprising positioning the port between the first apparel cup and the second apparel cup, the first apparel cup and the second apparel cup being in fluid communication.

* * * * *